US010486877B2

(12) United States Patent
Milbrandt et al.

(10) Patent No.: US 10,486,877 B2
(45) Date of Patent: Nov. 26, 2019

(54) HANG TAB AND PRODUCT TAG ASSEMBLY, AND METHOD OF USE

(71) Applicant: Bedford Industries, Inc., Worthington, MN (US)

(72) Inventors: Jay A. Milbrandt, Worthington, MN (US); Nicholas Elliott Shaffer, Ocheyedan, IA (US); Kim A. Milbrandt, Worthington, MN (US); Robert B. Ludlow, Worthington, MN (US); Colin M. O'Donnell, Worthington, MN (US)

(73) Assignee: Bedford Industries, Inc., Worthington, MN (US)

( * ) Notice: Subject to any disclaimer, the term of this patent is extended or adjusted under 35 U.S.C. 154(b) by 0 days.

(21) Appl. No.: 16/150,648

(22) Filed: Oct. 3, 2018

(65) Prior Publication Data

US 2019/0031416 A1 Jan. 31, 2019

Related U.S. Application Data

(63) Continuation of application No. 15/479,711, filed on Apr. 5, 2017, now Pat. No. 10,124,945, which is a (Continued)

(51) Int. Cl.
*B65D 73/00* (2006.01)
*B65D 23/00* (2006.01)
(Continued)

(52) U.S. Cl.
CPC ..... *B65D 73/0064* (2013.01); *B65B 15/00* (2013.01); *B65D 23/005* (2013.01); *B65D 23/14* (2013.01); *B65D 73/0071* (2013.01)

(58) Field of Classification Search
CPC .. B65D 23/005; B65D 73/0064; B65D 23/14; B65D 73/0071; B65B 15/00
(Continued)

(56) References Cited

U.S. PATENT DOCUMENTS 1,995,280 A * 3/1935 Everhart ..... B65D 71/0051 206/168
2,054,641 A * 9/1936 Stone ..... B65D 71/16 206/147
(Continued)

FOREIGN PATENT DOCUMENTS

DE 4402285 A1 10/1994
JP 2002-347841 A 12/2002
JP 2002347841 * 12/2002

OTHER PUBLICATIONS

Translation of JP-2002-347841, Container with neck Hanging label, Shin'ichi Inaba, Kao Corp. (Year: 2002).*
(Continued)

*Primary Examiner* — Muhammad Ijaz
(74) *Attorney, Agent, or Firm* — Mai-Tram D. Lauer; Westman, Champlin & Koehler, P.A.

(57) ABSTRACT

A hang tab and product tag assembly comprising a first panel, a second panel, and a third panel. The first panel includes an aperture configured to engage with a retention mechanism, the second panel includes an aperture that is configured to adjust to different dimensions.

15 Claims, 22 Drawing Sheets

Related U.S. Application Data continuation of application No. 13/390,001, filed as application No. PCT/US2010/045575 on Aug. 16, 2010, now Pat. No. 9,676,536.

(60) Provisional application No. 61/234,050, filed on Aug. 14, 2009.

(51) Int. Cl.
*B65D 23/14* (2006.01)
*B65B 15/00* (2006.01)

(58) Field of Classification Search
USPC .... 248/224.8, 300, 309.1, 312; 211/113, 85, 211/85.29, 70.6, 60.1, 120; 206/153, 158, 206/147, 168, 429, 459.1, 485, 806; 40/642.01
See application file for complete search history.

(56) References Cited

U.S. PATENT DOCUMENTS 2,057,618 A * 10/1936 Keith ..... B65D 71/0051 206/168
2,298,191 A * 10/1942 Boh ..... B65D 71/004 206/168
2,979,192 A * 4/1961 Blonder ..... B65D 5/4208 206/321
3,603,551 A 9/1971 Peterson
4,362,239 A * 12/1982 Roccaforte ..... B65D 73/0085 206/45.26
4,706,804 A * 11/1987 Hall ..... B65D 71/44 206/148
5,267,644 A * 12/1993 Tsao ..... B65D 71/48 206/151
5,344,006 A * 9/1994 Mazzeo ..... B65D 71/48 206/153
5,390,794 A * 2/1995 Vulpitta ..... B65D 73/00 206/459.1
5,493,801 A * 2/1996 James ..... G09F 3/0288 206/459.1
5,667,070 A * 9/1997 Miret ..... B65D 71/48 206/427
5,735,394 A * 4/1998 Harrelson ..... B65D 71/44 206/151
6,073,758 A * 6/2000 Webster ..... A47F 7/02 206/523
6,994,246 B2 * 2/2006 Ichikawa ..... B65D 5/4208 206/391
7,143,892 B2 * 12/2006 Kolton ..... A45C 11/16 206/6.1
7,836,622 B1 * 11/2010 King ..... G09F 3/14 206/820
8,083,126 B2 * 12/2011 Fleming ..... B65D 71/30 206/194
2005/0166439 A1 * 8/2005 Ludlow ..... G09F 3/14 40/665
2005/0252870 A1 11/2005 Roesler
2006/0091091 A1 * 5/2006 Tuan Mu ..... B65D 73/0014 211/70.6
2008/0272011 A1 * 11/2008 Levy ..... B65D 5/4208 206/45.28
2008/0296192 A1 * 12/2008 Tokie ..... B65D 23/005 206/459.5
2009/0152860 A1 * 6/2009 Bridges ..... G09F 3/02 283/81

OTHER PUBLICATIONS

Search report and examination opinion in corresponding European patent application No. 18185463.9, dated Oct. 9, 2018.
Patent Examination Report in Australian Patent Application No. 2010282317, dated Sep. 22, 2015.
Notice of Acceptance in Australian Patent Application No. 2010282317, dated Jul. 8, 2016.

* cited by examiner

HANG TAB AND PRODUCT TAG ASSEMBLY, AND METHOD OF USE

CROSS-REFERENCE TO RELATED APPLICATION(S)

The application is a continuation of U.S. patent application Ser. No. 15/479,711, filed on Apr. 5, 2017; which is a continuation of U.S. patent application Ser. No. 13/390,001, filed on Mar. 13, 2012, now U.S. Pat. No. 9,676,536; which is a section 371 U.S. National Phase Entry application from International patent application Ser. No. PCT/US10/45575, filed on Aug. 16, 2010; which claims the benefit of priority of U.S. Provisional Patent Application No. 61/234,050, filed on Aug. 14, 2009. These priority applications are hereby incorporated in their entireties.

BACKGROUND

The present disclosure is directed product display devices. In particular, the present disclosure is directed to devices for suspending and displaying products from retention mechanisms, such as retail display hooks or inventory storage.

In the product retail environment, products are often displayed for sale while mounted on hooks or rods. The product packaging or display component attached to the product has a hook or aperture that engages a generally horizontally disposed rod or a hook. Multiple units of a product may be displayed on a single rod, depending upon the length of the rod. Such arrangements are also useful for item storage and/or placement in other environments in addition to retail display and sale environments such as, for example, high-density item storage (while still allowing easy and ready retrieval of individual items).

The portion of the product or its packaging that engages the rod or hook is typically referred to as a hang tab. In order to reduce the cost of a product to the consumer, it is desirable to minimize excess packaging if possible. For example, if the product is sold in bottle form, product identification information, product use information, product source information and/or other indicia may be printed on the bottle or on labels attached to the bottle. Thus, a box for containing the bottle may be considered to be excess packaging, and will add to the end cost of the product. In that instance, however, the box may incorporate or have adhered to it a hang tab structure which facilitates display for sale of that bottle product on a rod.

SUMMARY

This Summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

An aspect of the present disclosure is directed to a hang tab and product tag assembly that includes a first panel having an aperture configured to engage with a retention mechanism, a second panel operably secured to the first panel, and a third panel operably secured to the second panel. The second panel includes an aperture that is configured to adjust to different dimensions.

Another aspect of the disclosure is directed to a hang tab and product tag assembly. The assembly includes a first panel having an aperture configured to engage with a retention mechanism, and a second panel configured to extend at an angle from the first panel. At least a portion of the second panel compositionally comprises an elastic material, where the portion of the elastic material defines an aperture through the second panel. The assembly also includes a third panel configured to extend at an angle from the second panel. The third panel includes a surface comprising information selected from the group consisting of textual indicia, illustrative indicia, tactile information, machine readable information, and combinations thereof.

A further aspect of the disclosure is directed to a method for displaying an item. The method includes providing an assembly comprising a first panel, a second panel, and a third panel, where the first panel and the second panel each have an aperture. The method also includes inserting at least a portion of the item through the aperture of the second panel, and allowing the aperture of the second panel to conform to dimensions of the portion of the item inserted through the aperture of the second panel. The method further includes inserting at least a portion of a retention mechanism through the aperture of the first panel, and suspending the first panel from the retention mechanism such that the first panel extends at a first angle relative to the second panel, and such that the second panel extends at a second angle relative to the third panel.

BRIEF DESCRIPTION OF THE DRAWINGS

The disclosed subject matter will be further explained with reference to the attached figures, wherein like structure is referred to by like reference numerals throughout the several views.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

The present disclosure is directed to a hang tab and product tab assembly, where a first panel of the assembly is configured to serve and a hang tab, and one or more second panels of the assembly serve to secure the assembly to a product (e.g., a bottle or item in other form), and one or more thirds panels of the assembly may serve as information or indicia bearing portions. This combination allows the assembly and the secured product to be suspended from a retention mechanism (e.g., a retail shelf hook). The combination also reduces product packaging requirements and provides advertising and/or information relative to a product, its use, or related products or promotions. As discussed below, the characteristics of elastic materials (and other bonding techniques) may be used to conform the assembly to irregularly shaped products, and can be used on a wide variety of products.

Figure 1:
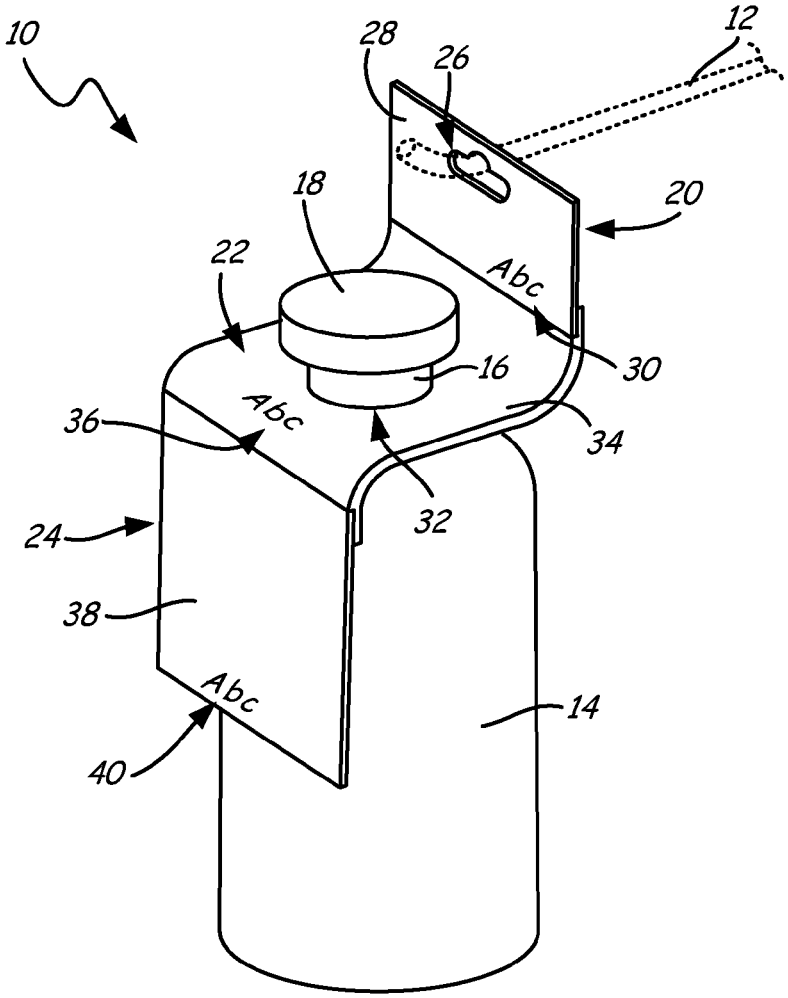
FIG. 1 is an isometric illustration of a hang tab and product tag assembly of the present disclosure, where the assembly is secured to a bottle and suspended from a hook for display.
Figure 2:
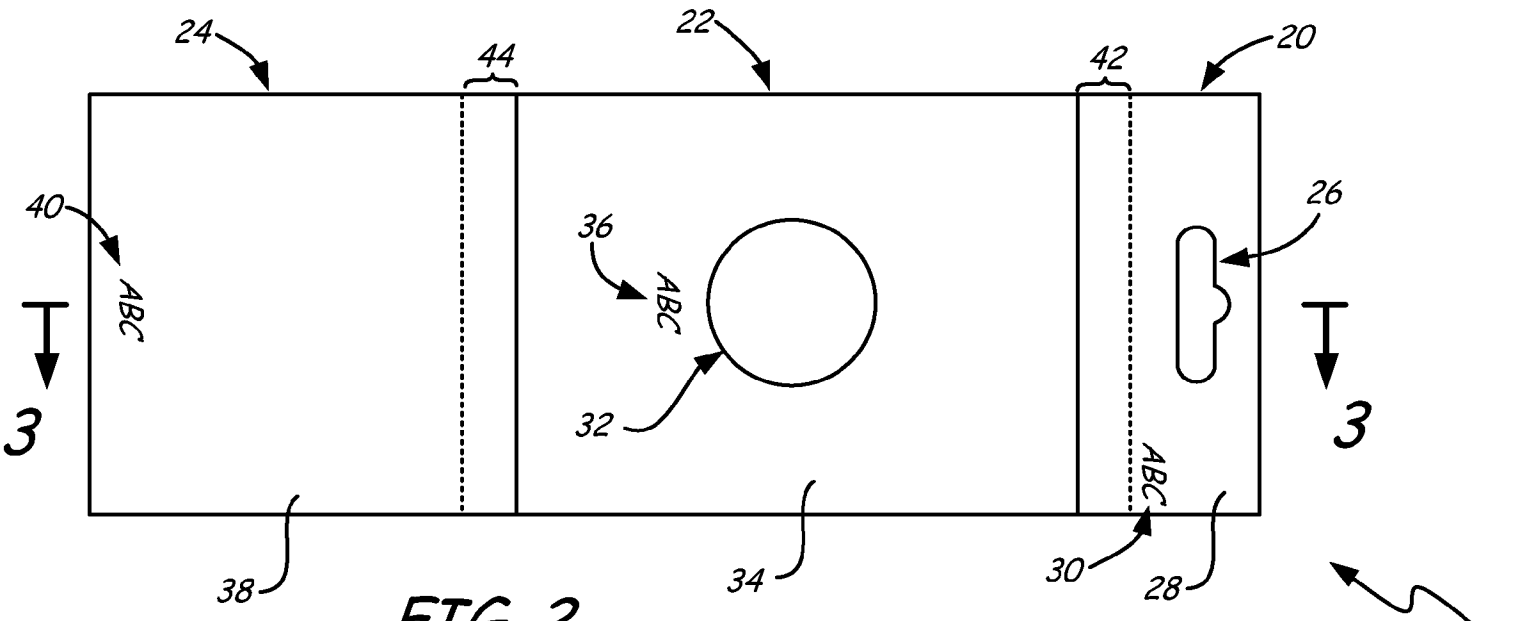
FIG. 2 is a top plan view of the assembly, prior to being mounted on an item.
Figure 3:
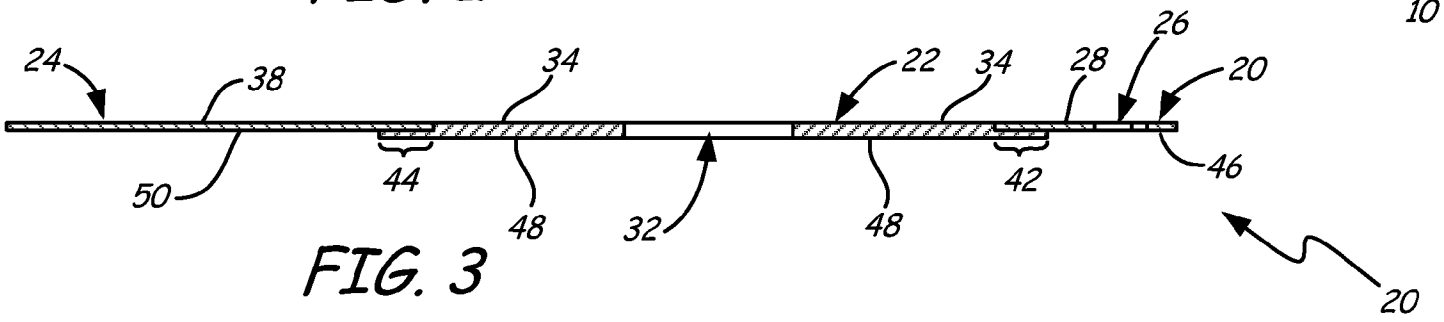
FIG. 3 is a sectional view of the assembly as taken along section lines 3-3 in FIG. 2.

FIGS. 1-3 illustrate one embodiment of the hang tab and product tag assembly of the present disclosure, referred to as assembly 10. As shown in FIG. 1, assembly 10 is suspended from hook 12 (shown with dashed lines) and is secured around bottle 14, where bottle 14 includes neck 16 and cap 18. Assembly 10 includes hang tab panel 20, aperture panel 22, and product tag panel 24, where aperture panel 22 interconnects hang tab panel 20 and product tag panel 24, and provides a suitable location for securing bottle 14 to assembly 10. The term "panel", such as for hang tab panel 20, aperture panel 22, and product tag panel 24, is used herein to distinguish the different components of the assemblies of the present disclosure, and is not intended to limit the components to particular geometries or functions. In other words, a "panel" is not limited to a generally sheet-like structure or to any particular shape, but may include three-dimensional features.

Hang tab panel 20 includes aperture 26 for engaging with hook 12 or any other suitable retention mechanism, where the dimensions of aperture 26 may vary depending on the desired retention mechanism. Hang tab panel 20 may be derived from one or more paper, polymeric, metallic, organic, and/or fabric materials. Suitable materials for hang tab panel 20 include those recited for the tag portions in Ludlow et al., U.S. Pat. No. 7,281,345 and Ludlow et al., International Application Publication No. WO07/084119, the contents of each of which are incorporated by reference in their entireties. For example, hang tab panel 20 may be derived from one or more printable card materials, such as materials commercially available under the trade designation "TESLIN" from PPG Industries, Pittsburgh, Pa. In one embodiment, hang tab panel 20 is formed at least in part from biodegradable, degradable, or recyclable materials.

In some embodiments, hang tab panel 20 is substantially inextensible (i.e., non-stretchable) and rigid to engage hook 12 without deformation. Hang tab panel 20 also includes front surface 28, which may include textual indicia (e.g., indicia 30), illustrative indicia, and/or a visible or otherwise detectable (e.g., tactile, machine readable, etc.) presentation of information.

Aperture panel 22 includes aperture 32, which is configured to retain products, such as bottle 14. Aperture panel 22 may be fabricated from one or more flexible, elastic materials, such as one or more elastomer materials. This allows hang tab panel 22 to project upwardly from aperture panel 22, at an angle relative to aperture panel 22, for engagement with hook 12 or any other suitable retention mechanism. The flexibility of aperture panel 22 also allows product tag panel 24 to hang downwardly relative to the product being displayed (e.g., bottle 14), and at an angle relative to aperture panel 22. Examples of suitable materials for aperture panel 22 include those recited for the flexible elastic portions disclosed in Ludlow et al., U.S. Pat. No. 7,281,345 and Ludlow et al., International Application Publication No. WO07/084119 (e.g., elastomer materials). In one embodiment, aperture panel 22 is formed at least in part from biodegradable, degradable, or recyclable materials.

The dimensions (e.g., diameter) of aperture 32 desirably allow assembly 10 to be affirmatively retained to the intended product, such as bottle 14. In one embodiment, the dimensions of aperture 32 are smaller than the cross-sectional area of the intended product, or is otherwise configured to deform or otherwise adjust in response to the shape of the intended product for insertion and removal of the product. For example, the diameter of aperture 32 is desirably smaller than the cross-sectional area of neck 16 and cap 18 of bottle 14. As such, bottle 14 may be retained to assembly 10 by inserting cap 18 and neck 16 through aperture 32 of aperture panel 22, thereby stretching the elastic material of aperture panel 22 from a relaxed state to a stretched state. When neck 16 is disposed through aperture 32, the elastic material of aperture panel 22, at least in the region adjacent to aperture 32, remains in the stretched state such that aperture 32 conforms to the dimensions of neck 16. This secures neck 16 within aperture 32 due to frictional resistance and/or due to the larger dimensions of cap 18.

Assembly 10 is also desirably removable from the product (e.g., bottle 14), such as when the product has been sold or removed from storage. To remove assembly 10 from bottle 14, assembly 10 and bottle 14 may be pulled in opposing directions to surpass the resistive force of aperture 32 around neck 16 and cap 18. In other words, assembly 10 may be removed from bottle 14 by pulling neck 16 and cap 18 out of aperture 32.

In some embodiments, the elastic material of aperture panel 22 may be "tuned" to the weight and shape of the product to be retained therein. For example, the elastic material of aperture panel 22 may be formed with increased rigidity for item theft protection and permanence of mounting of assembly 10 on the product. This may reduce the ease of removal of assembly 10 from the product, or may prevent removal of assembly 10 from the product without at least partial destruction of assembly 10 or of the product.

Aperture panel 22 also includes front surface 34, which may include textual indicia (e.g., indicia 36), illustrative indicia, and/or a visible or otherwise detectable (e.g., tactile, machine readable, etc.) presentation of information. Aperture panel 22 may take a variety of forms, so long as it serves to define aperture 32 for engaging a product. For instance, aperture panel 22 may, in some embodiments, be formed to attain desired properties for display of product tag panel 24 and/or indicia 36, such as to allow product tag panel 24 to hang straight relative to the product, or to be more eye-catching to a consumer/user by hanging at an angle relative to the product, by projecting outwardly from the product, or by being easily moved relative to the product (such as even by a gust of air).

In other embodiments, aperture panel 22 may be formed to allow itself and product tag panel 24 to conform to an irregularly-shaped item, or to allow aperture panel 22 (once disposed about a portion of the product) to assume a desired configuration (e.g., the shape of a bow-tie, a particular letter or number, a semaphore or a baseball glove), either alone or in combination with product tag panel 24 and/or hang tab panel 22. Aperture panel 22 may also be formed to have multiple apertures 32 for supporting a product (or a plurality of products) on a single assembly 10.

Product tag panel 24 may be derived from one or more paper, polymeric, metallic, organic, and/or fabric materials. Suitable materials for product tag panel 24 include those discussed above for hang tab panel 20. For example, in some embodiments, product tag panel 24 is substantially inextensible (i.e., non-stretchable) and rigid. This allows printing on front surface 38 to provide textual indicia (e.g., indicia 40), illustrative indicia, and/or a visible or otherwise detectable (e.g., tactile, machine readable, etc.) presentation of information.

In one embodiment, product tag panel 24 is formed at least in part from biodegradable, degradable, or recyclable materials. Accordingly, assembly 10 (any the below-discussed alternative assemblies) may aid in recycling. In the embodiments in which hang tab panel 20, aperture panel 22, and product tag panel 24 are formed at least in part from recyclable materials, after use, aperture panel 22 may be separated from hang tab panel 20 and product tag panel 24 and recycled as separate materials.

In one embodiment, a rear surface of product tag panel 24 (not shown in FIG. 1) may be bonded (e.g., by pressure sensitive adhesive or some other suitable bonding agent) to the product, such as to the body of bottle 14. In this embodiment, a layer of the bonding material (e.g., a pressure sensitive adhesive) may be provided on one or more portions of the rear surface of product tag panel 24. Additionally, the rear surface of product tag panel 24 may also include a release liner disposed over the bonding material, where the release liner may be removed prior to the fixation of assembly 10 onto the product, such as bottle 14.

As shown in FIG. 1, hang tab panel 20 and aperture panel 22 together perform support functions for bottle 14 (from hook 12). In this embodiment, product tag panel 24 does not perform a support function, and is suitable for displaying information on front surface 38 (e.g., indicia 40). During use, neck 16 and cap 18 of bottle 14 may be inserted through aperture 32 of aperture panel 22 to secure bottle 14 to assembly 10. Hang tab panel 20 may then be mounted on to hook 12 with aperture 26 to suspend assembly 10 and bottle 14 from hook 12. While suspended from hook 12, indicia or other information printed on one or more of front surfaces 28, 34, and 38 (e.g., indicia 30, 36, and 40) may then be prominently displayed. For example, front surface 28 of hang tab panel 20 and front surface 38 of product tag panel 24 are suitable for displaying information relating to bottle 14, such as brand logos, product identification, price information, universal product codes, and the like. As such, assembly 10 is a convenient and effective system for retaining and displaying products, such as bottle 14.

As shown in FIG. 2, aperture panel 22 is bonded to hang tab panel 20 at bond zone 42, and is bonded to product tag panel 24 at bond zone 44. Furthermore, hang tab panel 20, aperture panel 22, and product tag panel 24 are each illustrated as having rectangular geometries. In alternative embodiments, one or more of hang tab panel 20, aperture panel 22, and product tag panel 24 may be formed with any suitable geometry, so long as their purposes as explained above are retained, and there is suitable overlap of material in the respective bond zones 42 and 44 to define appropriate and reliable bonds therebetween. Likewise apertures 26 and 32 may be formed in any desired shape, so long as their respective functions are not compromised.

As shown in FIG. 3, hang tab panel 20 is flatly conjoined with aperture panel 22 along bond zone 42. In other words, hang tab panel 20 and aperture panel 22 are joined so that the sheet character of one of the panels extends into the sheet character of the other panel, giving a sheet-like character to the assembled panels. The result is a unifying flat bond zone 42 at the conjoining of hang tab panel 20 and aperture panel 22.

Similarly, product tag panel 24 is flatly conjoined with aperture panel 22 along bond zone 44. In other words, product tag panel 24 and aperture panel 22 are joined so that the sheet character of one of the panels extends into the sheet character of the other panel, giving a sheet-like character to the assembled panels. The result is a unifying flat bond zone 44 at the conjoining of aperture panel 22 and product tag panel 24.

As further shown in FIG. 3, hang tab panel 20, aperture panel 22, and product tag panel 24 respectively include rear surfaces 46, 48, and 50, which are the respective opposing surfaces to front surfaces 26, 34, and 38. In some embodiments, one or more of rear surfaces 46, 48, and 50 may include textual indicia, illustrative indicia, and/or a visible or otherwise detectable (e.g., tactile, machine readable, etc.) presentation of information.

Prior to affixation to a product, such as bottle 14 (shown in FIG. 1), assembly 10 exhibits sheet-like dimensions in the sense that hang tab panel 20, aperture panel 22, and product tag panel 24 are each of flat character and are generally co-planar. In some embodiments, depending on the composition and film thickness, aperture panel 22 may be drapeable and floppy and thus not always displayed in flat form due to the elastic material(s).

As discussed above, in the shown embodiment, hang tab panel 20 and aperture panel 22 together perform support functions for bottle 14, and product tag panel 24 does not perform a support function. Accordingly, in some embodiments, hang tab panel 20 may be fabricated from thicker and/or more rigid materials compared to the dimensions and materials of product tag panel 24. Furthermore, for the same reason, in some embodiments, bond zone 42 between hang tab panel 20 and aperture panel 22 may exhibit a greater bond strength (e.g., via a greater bonding surface area) compared to the bond strength of bond zone 44 between aperture panel 22 and product tag panel 24.

Figure 3A:
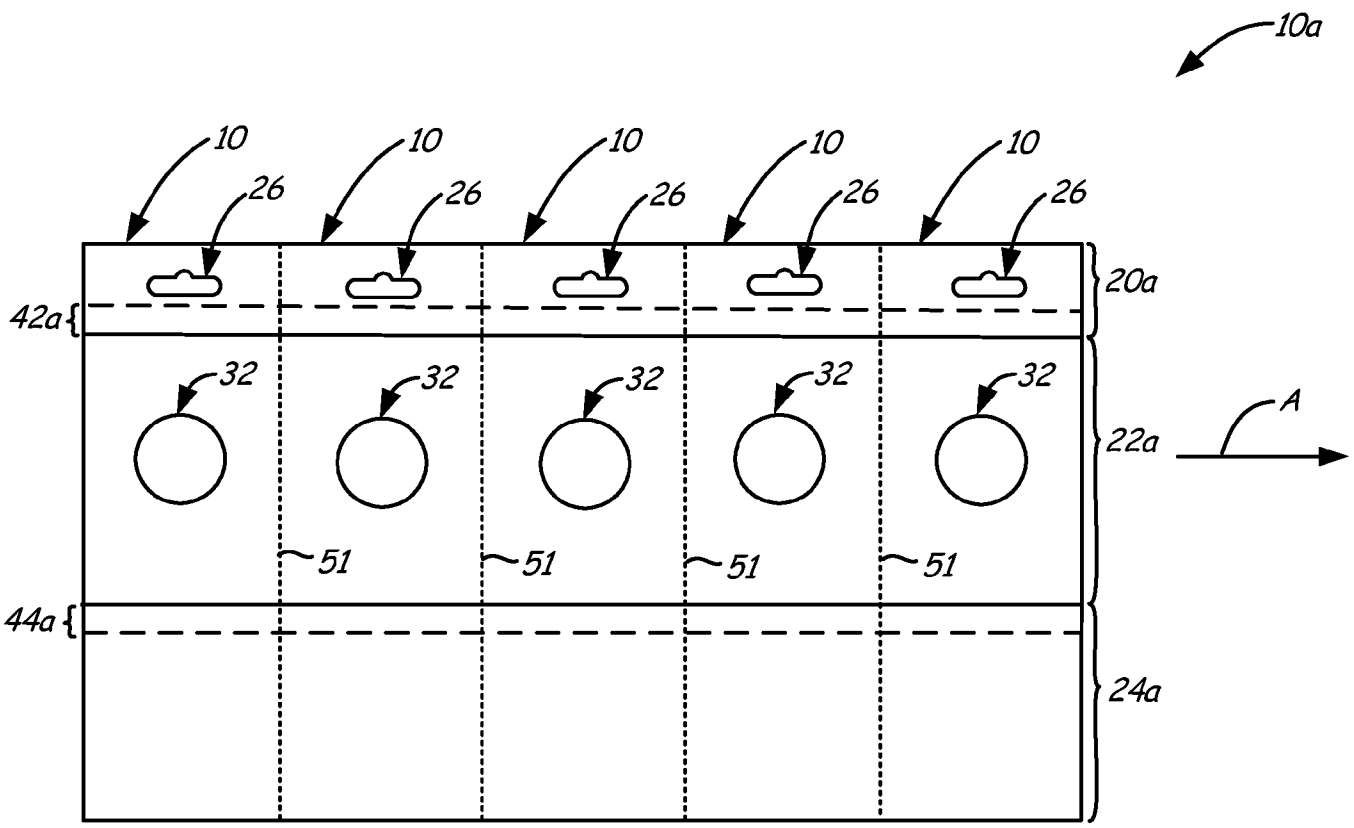
FIG. 3A is a top plan view of a sheet of multiple assemblies, illustrating a technique for manufacturing the assemblies.

FIG. 3A illustrates sheet 10*a*, which is a manufactured sheet that includes multiple assemblies 10. Assembly 10 may be manufactured using a variety of different techniques. Examples of suitable techniques for manufacturing assembly 10 include those disclosed in Ludlow et al., U.S. Pat. No. 7,281,345 and Ludlow et al., International Application Publication No. WO07/084119. For example, as shown in FIG. 3A, a sheet of multiple assemblies 10 (e.g., sheet 10*a*) may be manufactured using a continuous web-based process, where adjacent assemblies 10 may be separable with score or perforation lines 51.

In this embodiment, a strip of tab material for the hang tab panels 20 (referred to as hang tab strip 20*a*) and a strip of tag material for the product tag panels 24 (referred to as product tag strip 24*a*) may advance in the direction of arrow A, and may be aligned with an advancing strip of elastic material for the aperture panels 22 (referred to as intermediate strip 22*a*). Strips 20*a*, 22*a*, and 24*a* may then be bonded together at bond zone areas 42*a* and 44*a*, which correspond to bond zones 42 and 44 for each assembly 10. Strips 20*a*, 22*a*, and 24*a* may be bonded together using a variety of different bonding techniques, such as thermal bonding, adhesive bonding, ultrasonic bonding, and the like. Examples of suitable bonding techniques are disclosed in Maltas et al., U.S. Pat. No. 7,763,135.

In some embodiments, hang tab strip 20*a* and/or product tag strip 24*a* may have indicia or other information already applied prior to the bonding step. Alternatively, after the bonding of strips 20*a*, 22*a*, and 24*a*, indicia or other information may be printed to one or more of the strips 20*a*, 22*a*, and 24*a*. Since hang tab strip 20*a* and product tag strip 24*a* are provided as separate strips, proper alignment and registration of hang tab strip 20*a* and product tag strip 24*a* are desired to reduce the risk of printing errors. Score or perforation lines 51 may then be formed in the advancing sheet 10*a* to define the separable assemblies 10, and apertures 26 and 32 may be cut out of the advancing sheet for each assembly 10. Likewise, other shaping or processing of the bonded strips 20*a*, 22*a*, and 24*a* may be accomplished. After the manufacturing process is complete, the individual assemblies 10 may be separated for individual use, or maintained in sheet or roll form for bulk shipping and subsequent use.

FIGS. 4-32 illustrate examples of suitable alternative hang tab and product tag assemblies of the present disclosure, where indicia corresponding to indicia 30, 36, and 40 are omitted for ease of discussion. As discussed below, the features of each alternative assembly may be interchangeable with any of the assemblies discussed herein, so long as their intended functions are not compromised.

Furthermore, each of the below-discussed assemblies may be manufactured using similar processes to that discussed above for sheet 10*a* (shown in FIG. 3A), where particular differences in the manufacturing process for a given alternative assembly are noted below. For example, in some embodiments, the hang tab strips and/or product tag strips may have indicia or other information already applied prior to the bonding step. Alternatively, after the bonding of the strips, indicia or other information may be printed to one or more of the strips. In some of the embodiments, the hang tab strips and product tag strips are provided as separate strips. In these embodiments, proper alignment and registration of the hang tab strip, the aperture strips, and/or the product tag strips are desired to reduce the risk of printing errors.

In each of the below-discussed assemblies, the panels are desirably joined so that the sheet character of at least a portion of one of the panels extends into the sheet character of at least a portion of the other panel, giving a sheet-like character to the assembled panels, at least adjacent to their respective bond zones. This desirably results in unifying flat bond zones at the conjoining of adjacent panels, as discussed above for assembly 10 (shown in FIGS. 1-3A). As such, prior to affixation to products, each alternative assembly desirably exhibits sheet-like dimensions in the sense that the panels (at least where bonded together) are each of flat character and are generally co-planar. In some embodiments, depending on the compositions and film thicknesses, panels derived from elastic materials may be drapeable and floppy and thus not always displayed in flat form due to the elastic materials.

Figure 4:
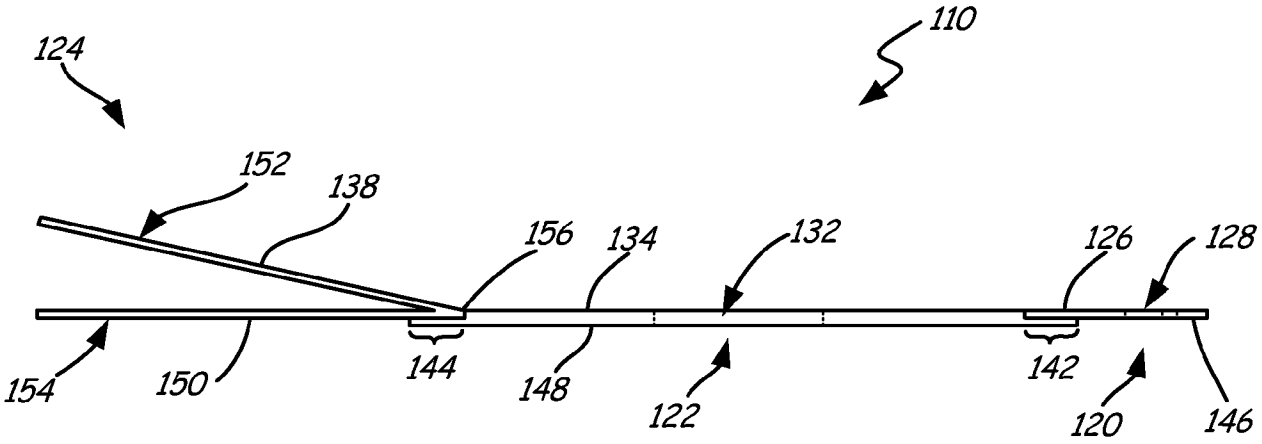
FIG. 4 is a side elevational view of a first alternative embodiment of the assembly, which includes a product tag panel having a foldable-tag design.

FIG. 4 is a side elevational view of assembly 110, which is a first alternative to assembly 10 (shown in FIGS. 1-3A), and where the respective reference labels are increased by "100". In the embodiment shown in FIG. 4, assembly 110 includes product tag panel 124 having a foldable-tag design. Product tag panel 124 is formed from a folded-over panel assembly having front panel 152 (defining front surface 138) and rear panel 154 (defining rear surface 150), where front panel 152 and rear panel 154 are connected together along a lateral hinge line 156. Front panel 152 and rear panel 154 may be formed from the same sheet of panel material, which is folded over at hinge line 156.

As illustrated in FIG. 4, bond zone 144 between the aperture panel 122 and product tag panel 124 engages a portion of the rear panel 154, as well as hinge line 156. An example of suitable arrangement for bond zone 144 includes the tag to elastomer bonding arrangement disclosed in U.S. patent application Ser. No. 11/529,697, which is incorporated by reference in its entirety. Thus, product tag panel 124 includes more panel faces compared to product tag panel 24 (shown in FIGS. 1-3A). This provides additional space for product advertisement, information and/or other indicia to be presented by assembly 110 relative to the product to which it may be mounted (e.g., bottle 14, shown in FIG. 1), and/or for the purpose of promoting related products and/or services.

Product tag panel 124 is illustrated as bi-fold tag as having two panels (i.e., front panel 152 and rear panel 154). In alternative embodiments, product tag panel 124 may be a tri-fold tag having two folds and thus three panels. In additional alternative embodiments, product tag panel may have four or more folds and additional panels, as desired.

Figure 5:
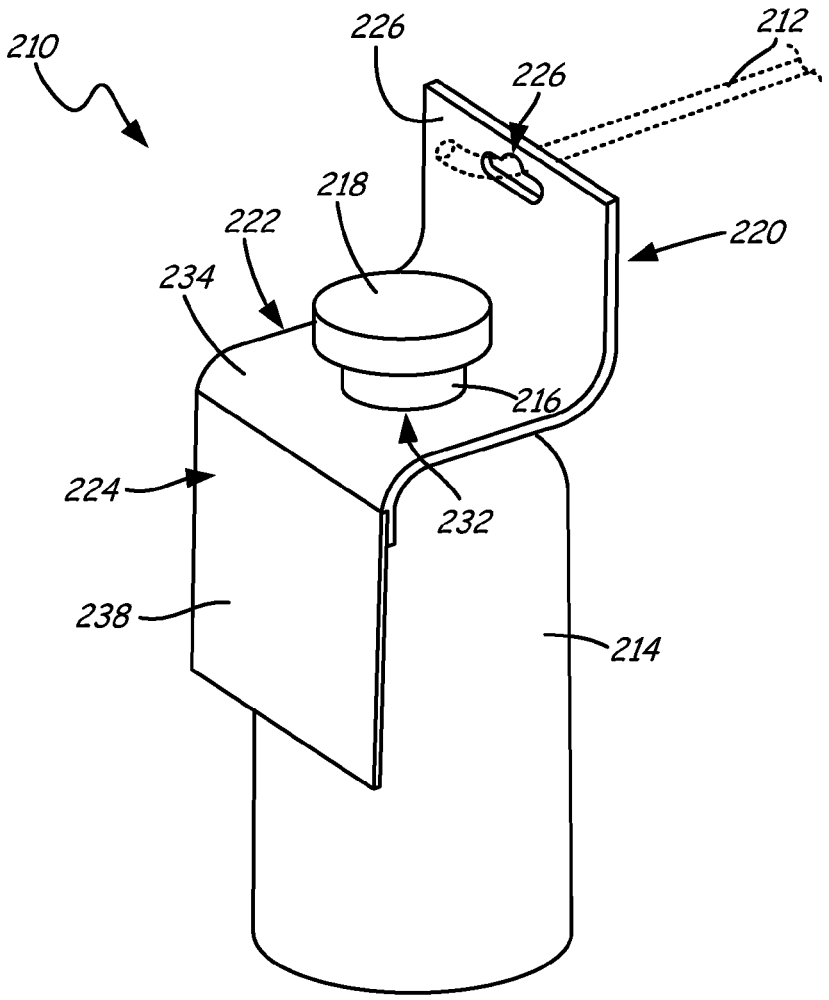
FIG. 5 is an isometric illustration of a second alternative embodiment of the assembly, where the second alternative assembly is secured to a bottle and suspended from a hook for display, and where the second embodied assembly includes a hang tab panel that is integrally formed with an aperture panel of the assembly.
Figure 6:
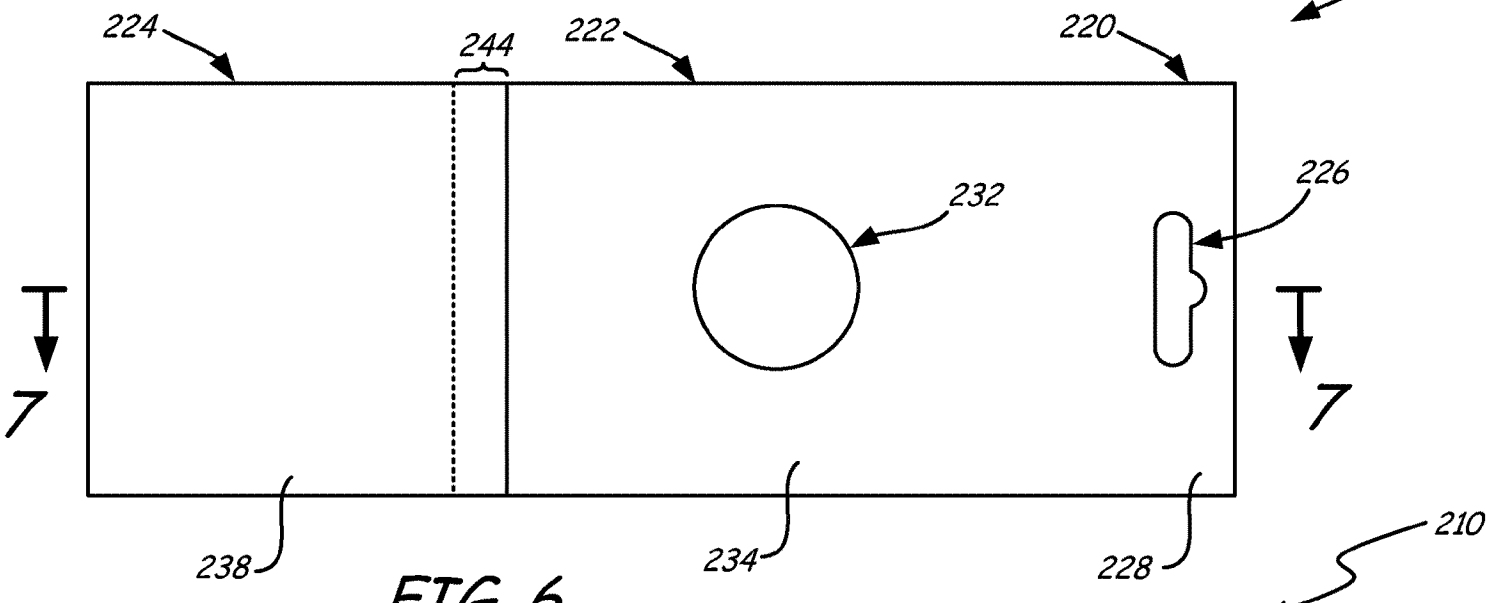
FIG. 6 is a top plan view of the second alternative assembly.
Figure 7:
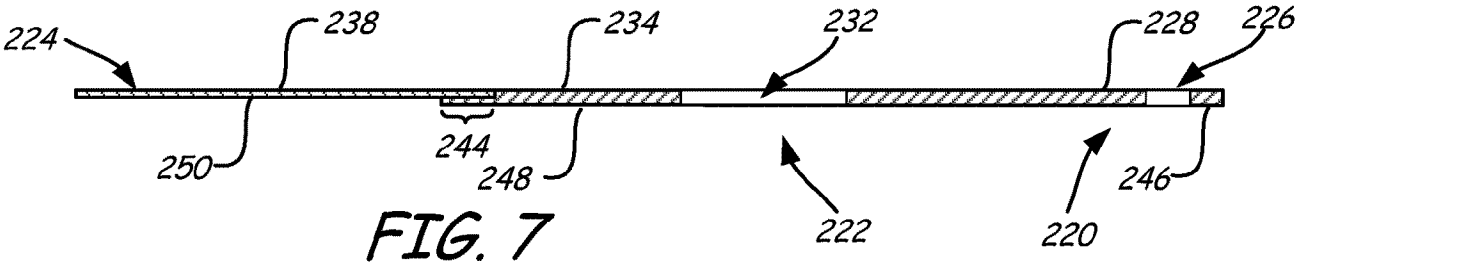
FIG. 7 is a sectional view of the second alternative assembly as taken along section lines 7-7 in FIG. 6.

FIGS. 5-7 illustrate assembly 210, which is a second alternative to assembly 10 (shown in FIGS. 1-3A), and where the respective reference labels are increased by "200" relative to FIGS. 1-3. As shown in FIG. 5, assembly 210 includes hang tab panel 220 and aperture panel 222, which are integrally fabricated from one or more elastic materials. Accordingly, in this embodiment, hang tab panel 220 is also derived from one or more elastic materials. Examples of suitable materials for hang tab panel 220 and aperture panel 222 include those discussed above for aperture panel 22 (shown in FIGS. 1-3A).

The elastic material defining hang tab panel 220 and aperture panel 222 includes apertures 226 and 232, which respectively function in the same manner as apertures 26 and 32 (shown in FIGS. 1-3A) for suspending bottle 214 from hook 212. During use, neck 216 and cap 218 of bottle 214 may be inserted through aperture 232 of aperture panel 222 to secure bottle 214 to assembly 210. Hang tab panel 228 may then be mounted to hook 212 with aperture 226 to suspend to assembly 210 and bottle 214 from hook 212. While suspended from hook 212, indicia or other information printed on one or more of front surfaces 228, 234, and 238 may then be prominently displayed. For example, front surface 238 of product tag panel 224 is suitable for displaying information relating to bottle 214.

As shown in FIGS. 6 and 7, assembly 210 includes a single bond zone 244, where the bond zone corresponding to bond zone 40 (shown in FIGS. 2 and 3) is omitted. In this embodiment, the elastic material at hang tab panel 220 may be stiffened and/or hang tab panel 220 may exhibit a greater film thickness to allow hang tab panel 220 to function as a hang tab without undue deformation.

As discussed above, assembly 210 may be manufactured using a similar process to that discussed above for assembly 10 and sheet 10*a* (shown in FIG. 3A). In this embodiment, however, a single strip of tag material for the product tag panels 224 may be aligned with and bonded to a strip of elastic material for the hang tab panels 220/aperture panels 222.

Figure 8:
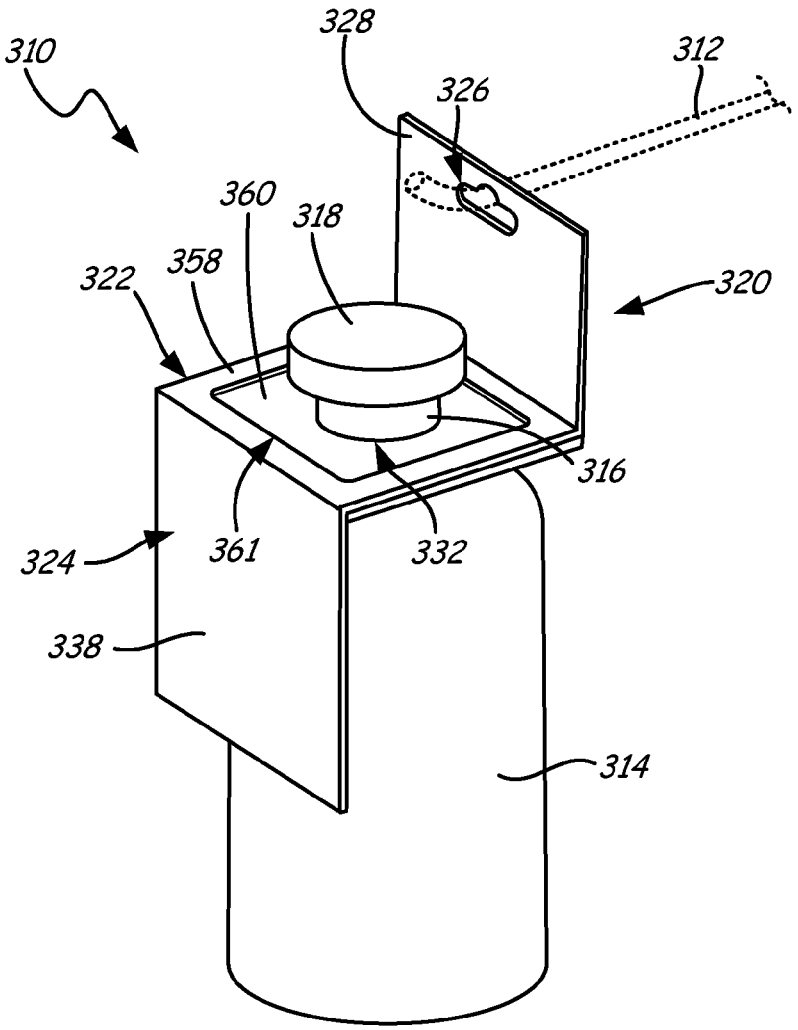
FIG. 8 is an isometric illustration of a third alternative embodiment of the assembly, where the third alternative assembly is secured to a bottle and suspended from a hook for display, and where the third embodied assembly includes an aperture panel having an elastic region surrounded by a non-elastic border.
Figure 9:
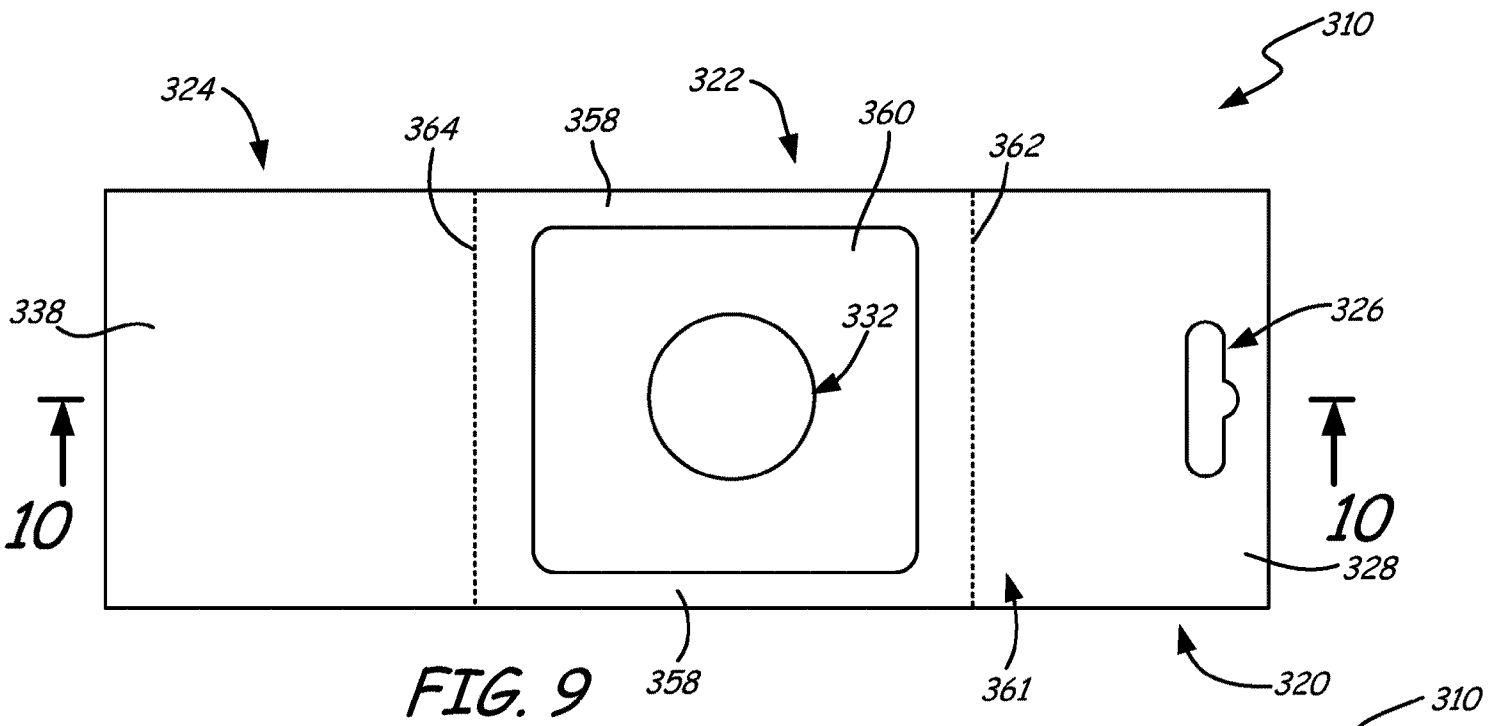
FIG. 9 is a top plan view of the third alternative assembly.
Figure 10:
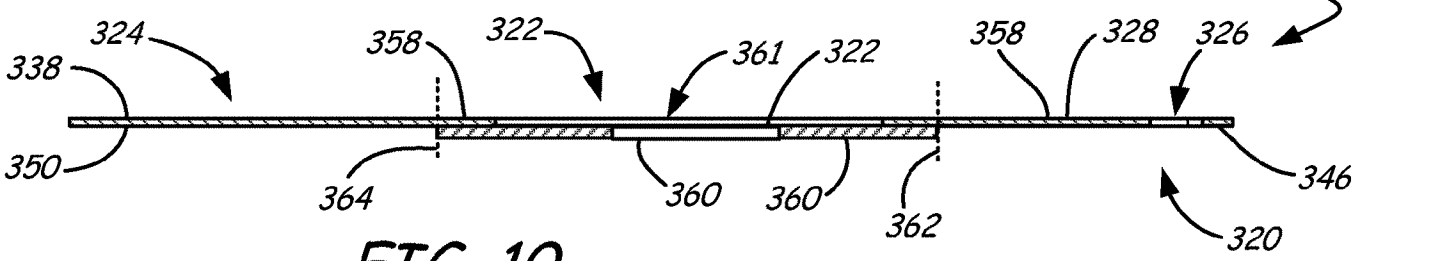
FIG. 10 is a sectional view of the third alternative assembly as taken along section lines 10-10 in FIG. 9.

FIGS. 8-10 illustrate assembly 310, which is a third alternative to assembly 10 (shown in FIGS. 1-3A), and where the respective reference labels are increased by "300" relative to FIGS. 1-3. As shown in FIG. 8, assembly 310 includes hang tab panel 320, aperture panel 322, and product tag panel 324, where aperture panel 322 includes border 358 and elastic region 360.

Functionally, hang tab panel 320 and product tag panel 324 may provide the same advantages as the hang tab panels and product tag panels described above. However, in this embodiment, a single sheet of tab/tag material defines hang tab panel 320, border 358 of aperture panel 322, and product tab panel 324. Accordingly, hang tab panel 320, border 358 of aperture panel 358, and product tag panel 324 may be fabricated from one or more paper, polymeric, metallic, organic, and/or fabric materials. Suitable materials for hang tab panel 320, border 358 of aperture panel 358, aperture panel 358, and product tag panel 324 include those discussed above for hang tab panel 20 (shown in FIGS. 1-3A).

Border 358 extends around and is secured to elastic region 360, where elastic region 360 is fabricated from one or more elastic materials, and includes aperture 332. Suitable materials for elastic region 360 include those discussed above for aperture panel 22 (shown in FIGS. 1-3A). Accordingly, elastic region 360 is exposed through opening 361, where opening 361 is the opening defined by border 358.

In the embodiment shown in FIGS. 9 and 10, elastic region 360 extends across opening 361 to be generally coextensive with top end 362 and bottom end 364 of aperture panel 322. Terms designating orientation, such as "top", "bottom", "upper", "lower", and the like are used herein for ease of discussion, and are not intended to limit the assemblies of the present disclosure to any particular orientations of assembly or use.

Opening 361 is larger than the dimensions of aperture 332 and aperture 332 is spaced from inner edges of border 358. Thus, the elastic material of elastic region 360 is provided completely around all sides of aperture 332 before elastic region 360 engages border 358. At those areas where the elastic region 360 engages border 358, elastic region 360 and border 358 may be bonded together along a bond zone. In one embodiment, the bond zone is coextensive with border 358 of aperture panel 322, and thus generally rectangular.

Assembly 310 may be mounted upon a product, such as bottle 314 (shown in FIG. 8), using aperture 322 in the manner as discussed above for assembly 10. The tab/tag material may be scored, creased or otherwise formed (e.g., at top end 362) to allow bending of hang tab panel 320 relative to aperture panel 322. Similarly, the tab/tag material may be scored, creased or otherwise formed (e.g., at bottom end 364) to allow bending of product tag panel 324 relative to aperture panel 322.

Since the amount of tab/tag material is reduced in aperture panel 322, the tab/tag material at border 358 may be flexible enough to allow bending of aperture panel 322 to thereby allow hang tab panel 320 and product tag panel 324 to be aligned at angles relative to aperture panel 322, such as for forming an assembly arrangement like that discussed above for assembly 10. Alternatively, the tab/tag material may include additional score lines or creases or be otherwise formed to allow ready bending along the lateral sides of border 358, making aperture panel 322 more flexible to accommodate its desired mounting configuration upon a product, such as bottle 314.

Assembly 310 may be manufactured using a similar process to that discussed above for assembly 10 and sheet 10*a* (shown in FIG. 3A). However, assembly 310 allows hang tab panel 320 and product tag panel 324 to be formed from the same sheet of tab/tag material. This is advantageous for applying printing or other indicia to hang tab panel 322 and product tag panel 324, since those panels will always be joined together with border 358 for alignment and registration purposes. As discussed above, such registration is desirably maintained when multiple panels are being assembled in a single hang tab and product tag assembly, such as assemblies 10 and 110, particularly when multiple assemblies are formed in series or strip form, as discussed above (e.g., sheet 10*a*, shown in FIG. 3A). In addition, the inclusion of the tab/tag material in border 358, along with elastic region 360, may be desired in some applications to add rigidity to assembly 310.

Figure 11:
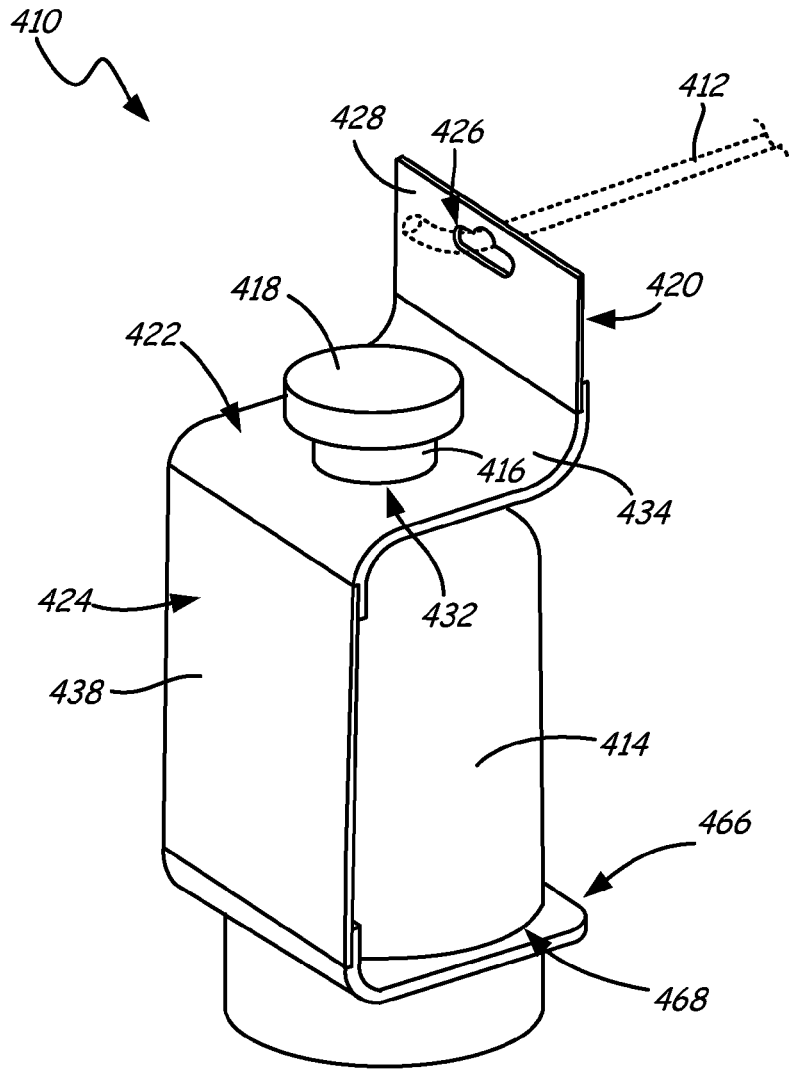
FIG. 11 is an isometric illustration of a fourth alternative embodiment of the assembly, where the fourth alternative assembly is secured to a bottle and suspended from a hook for display, and where the fourth embodied assembly includes a lower aperture panel.
Figure 12:
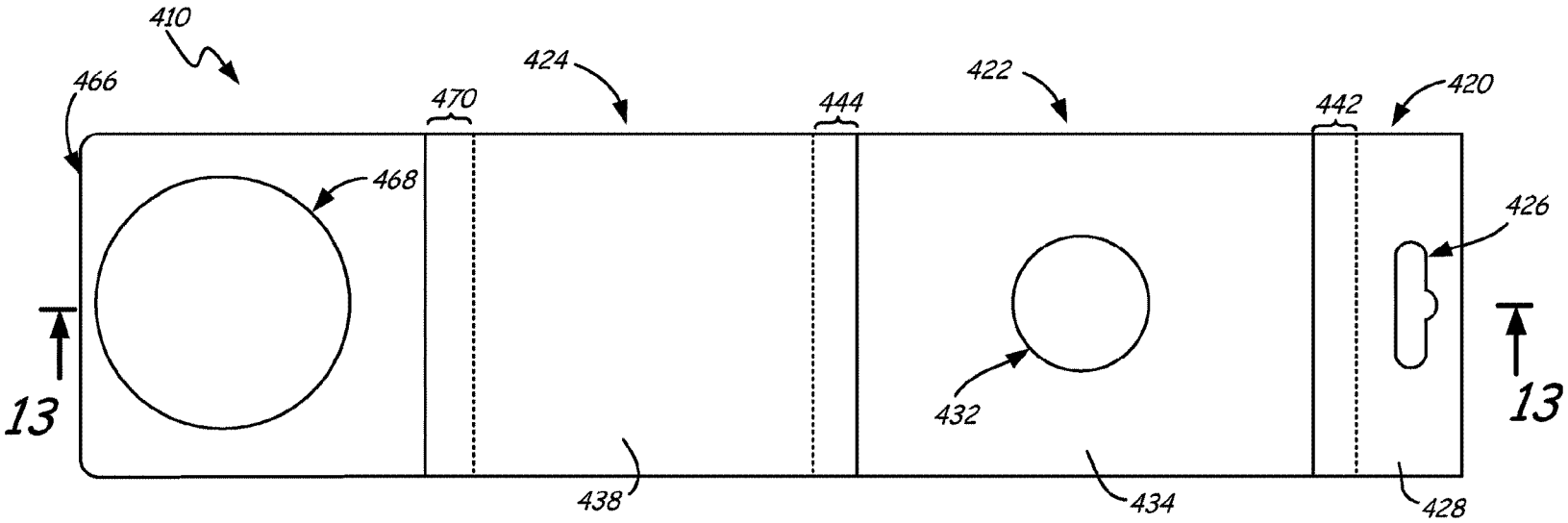
FIG. 12 is a top plan view of the fourth alternative assembly.
Figure 13:
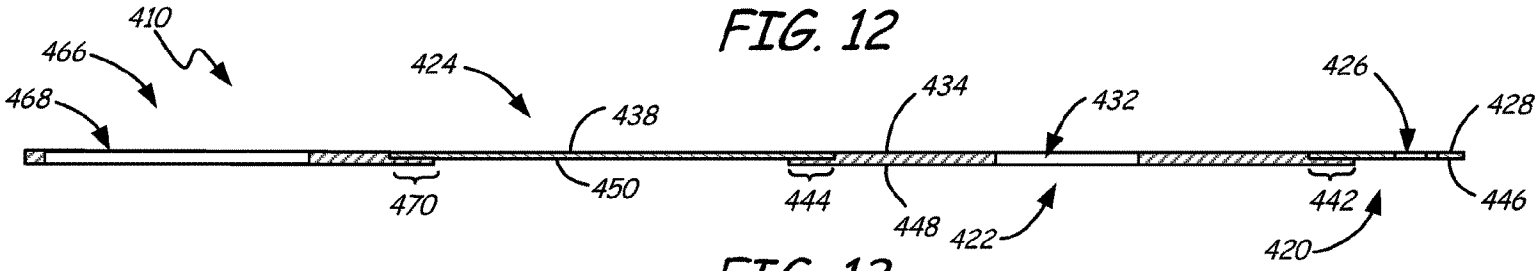
FIG. 13 is a sectional view of the fourth alternative assembly as taken along section lines 13-13 in FIG. 12.

FIGS. 11-13 illustrate assembly 410, which is a fourth alternative to assembly 10 (shown in FIGS. 1-3A), and where the respective reference labels are increased by "400" relative to FIGS. 1-3. As shown in FIG. 11, assembly 410 includes hang tab panel 420, aperture panel 422, and product tag panel 424, which may function in the same manner as hang tab panel 20, aperture panel 22, and product tag panel 24 (shown in FIGS. 1-3A).

Assembly 410 also includes lower aperture panel 466 bonded to the opposing end of product tag panel 424 from aperture panel 422. Suitable materials for lower aperture panel 466 include those discussed above for aperture panel 22, where lower aperture panel 446 includes aperture 468. Accordingly, lower aperture panel 446 provides a second location for securing assembly 410 to a product, such as bottle 414.

This second attachment location serves the function of more securely attaching the assembly 410 to a product, and also for aligning product tag panel 424 generally upright (or in some other desired orientation) relative to the product, as defined by the properties of aperture panel 422 and lower aperture panel 466, and the respective positions of apertures 432 and 468. Lower aperture panel 366 may also include textual indicia, illustrative indicia, and/or a visible or otherwise detectable (e.g., tactile, machine readable, etc.) presentation of information.

During use, neck 416 and cap 418 of bottle 414 may be inserted through aperture 432 of aperture panel 422, and the body of bottle 414 may be inserted through aperture 468 of elastic panel 466, thereby securing bottle 414 to assembly 410. Hang tab panel 428 may then be mounted on hook 412 with aperture 426 to suspend to assembly 410 and bottle 414 from hook 412. While suspended from hook 412, indicia or other information printed on one or more of front surfaces 428, 434, and 438 may then be prominently displayed. For example, front surface 428 of hang tab panel 420 and front surface 438 of product tag panel 424 are suitable for displaying information relating to bottle 414. As such, assembly 410 is also a convenient and effective system for retaining and displaying products, such as bottle 414.

As shown in FIG. 12, product tag panel 424 and elastic panel 466 are bonded together along bond zone 470. Additionally, the dimensions of aperture 468 may vary based on the dimensions of the intended products to be secured. For example, in the shown embodiment, aperture 468 has a diameter that is greater than the diameter of aperture 432 to compensate for the differences in diameters between the body of bottle 414 and neck 416.

Assembly 410 may also be manufactured using a similar process to that discussed above for assembly 10 and sheet 10*a* (shown in FIG. 3A). In this embodiment, however, an additional strip of elastic material for the lower aperture panels 466 may be aligned with and bonded to tab material strip for the product tag panels 424, thereby forming the bond zone 470 for each assembly 410.

As discussed above, in alternative embodiments, the use of lower aperture panel 466 with aperture 468 may be combined with any of the alternative features discussed herein, so long as their intended functions are not compromised. For example, the use of lower aperture panel 466 with aperture 468 may be combined with the foldable-tag design of assembly 110 (shown in FIG. 4), with the extended elastic material design of assembly 210 (shown in FIGS. 5-7), and with the border/elastic region design of assembly 310 (shown in FIGS. 8-10). The combination of the border/elastic region design of assembly 310 is particularly suitable for use with elastic panel 466 with aperture 468, thereby providing assembly 310 an additional mechanism for being secured to a product.

Figure 14:
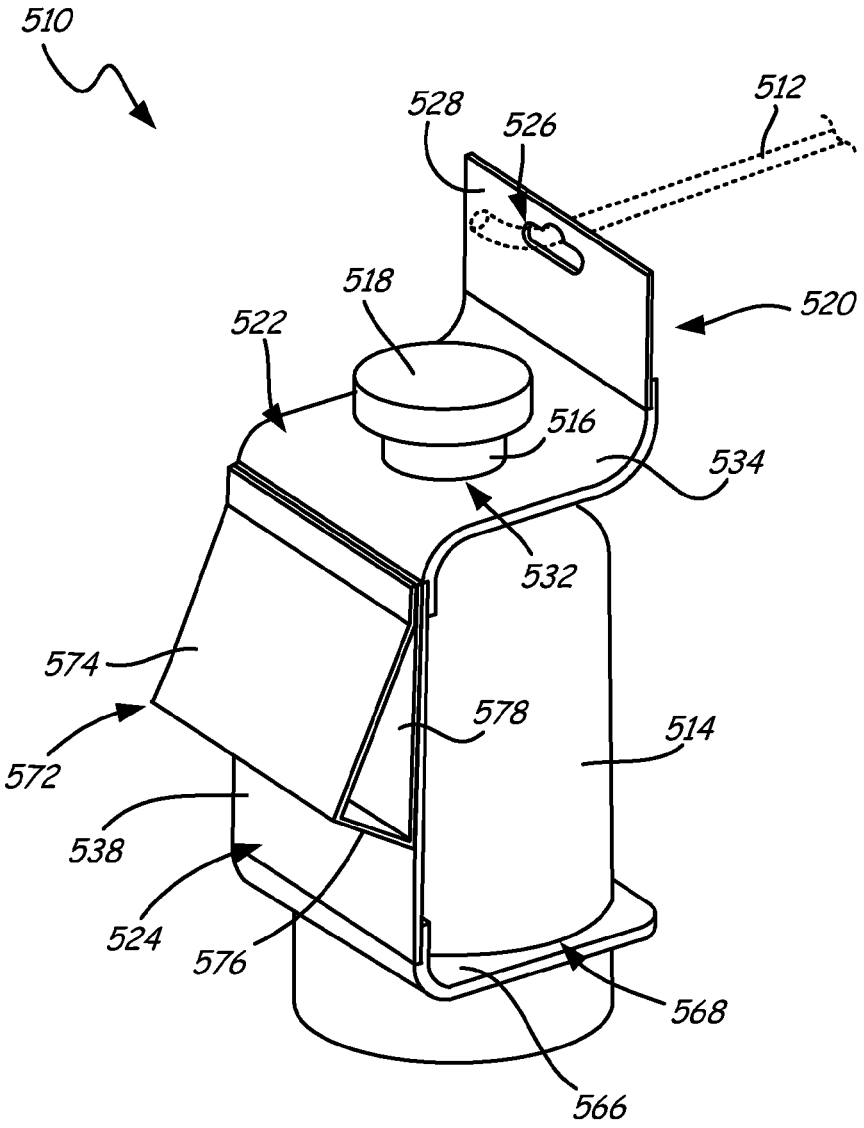
FIG. 14 is an isometric illustration of a fifth alternative embodiment of the assembly, where the fifth alternative assembly is secured to a bottle and suspended from a hook for display, and where the fifth embodied assembly includes a lower aperture panel and a foldable carrier secured to a product tag panel of the assembly.

FIGS. 14-17 illustrate assembly 510, which is a fifth alternative to assembly 10 (shown in FIGS. 1-3A), and where the respective reference labels are increased by "500" relative to FIGS. 1-3. As shown in FIG. 14, assembly 510 includes hang tab panel 520, aperture panel 522, product tag panel 524, and lower aperture panel 566, which may function in the same manner as hang tab panel 420, aperture panel 422, product tag panel 424, and lower aperture panel 466 (shown in FIGS. 11-13).

In this embodiment, product tag panel 524 also includes carrier 572, which is a foldable sheet that includes front portion 574, central portion 576, and rear portion 578. As shown, the top ends of front portion 574 and rear portion 578 of carrier 572 are secured together adjacent to aperture panel 522, and their bottom ends are offset from each by central portion 576. As discussed below, carrier 572 is suitable for bearing items, such as product samples and the like, thereby allowing such items to be retained with the products secured to assembly 510 (e.g., bottle 514).

Figure 15:
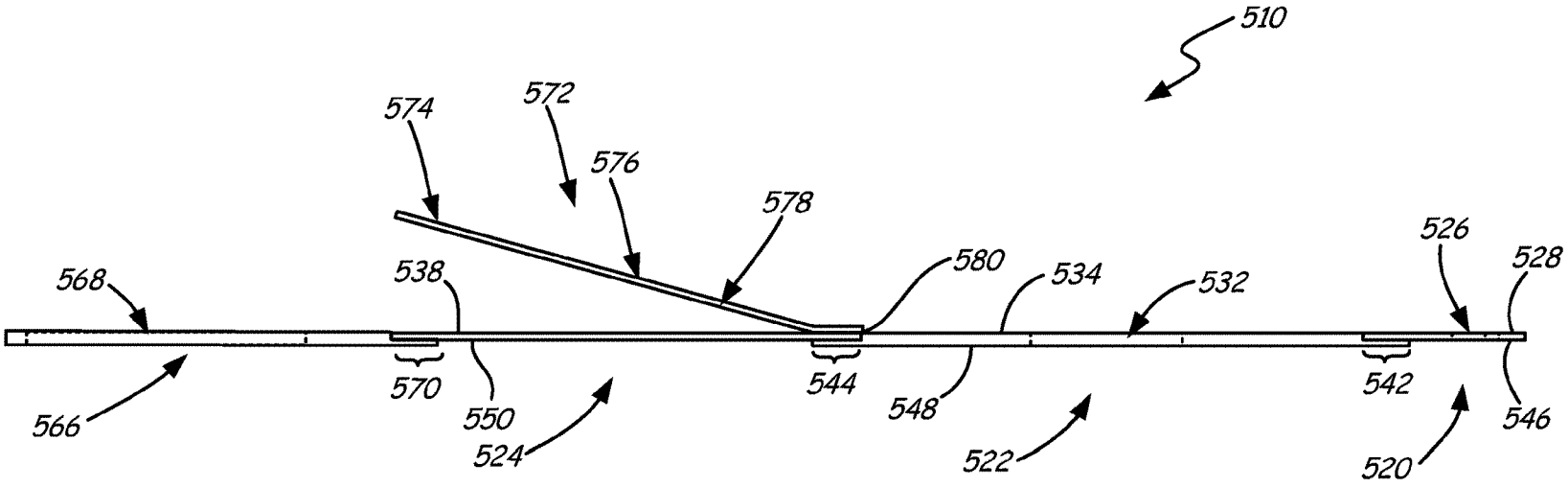
FIG. 15 is a side elevational view of the fifth alternative assembly.

As shown in FIG. 15, prior to being used with bottle 514 (shown in FIG. 14), front portion 574, central portion 576, and rear portion 578 of carrier 572 may extend in an unfolded and flat arrangement. As further shown, rear portion 578 of carrier 572 is secured to product tag panel 524 at lateral hinge line 580. Bond zone 544 between the aperture panel 522 and product tag panel 524/carrier 572 engages a portion of product tag panel 524, as well as hinge line 580, in the same manner as discussed above for assembly 110 (shown in FIG. 4). As such, carrier 572 and product tag panel 524 may be formed from the same sheet of panel material, which is folded over at hinge line 580 in the same manner as discussed above for assembly 110.

Figure 16:
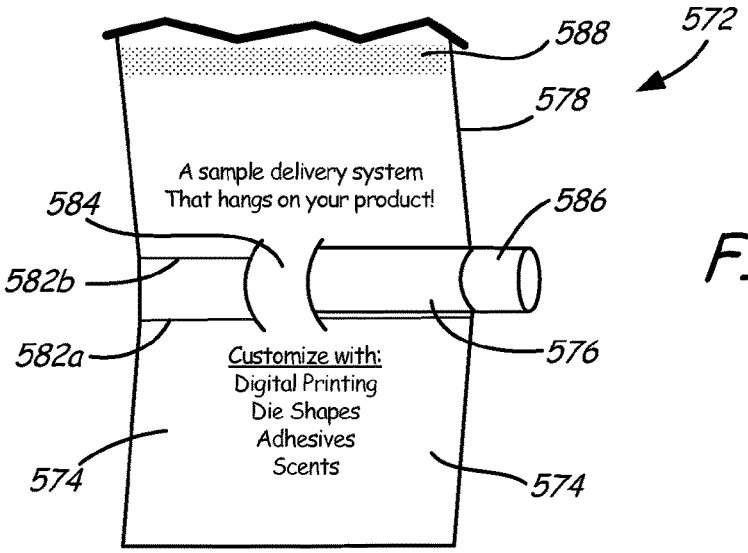
FIG. 16 is an isometric illustration of the foldable carrier of the fifth alternative assembly in use with a sample product, where the foldable carrier is in a partially-folded arrangement.

In FIG. 16, carrier 572 is shown in a partially-folded arrangement. Front portion 574 and central portion 576 are foldable along crease or fold line 582*a*, and central portion 576 and rear portion 578 are foldable along crease or fold line 582*b*. Carrier 572 also includes longitudinal slits therethrough normal to fold lines 582*a* and 582*b* that define flap 584. As shown, when carrier 572 is folded, flap 584 may extend outward to receive a product sample (e.g., sample 586).

As further shown, rear portion 578 includes adhesive band 588, which is a band of one or more adhesive materials (e.g., one or more pressure sensitive adhesives). When carrier 572 is folded to the arrangement shown in FIG. 14, front portion 574 may engage adhesive band 588, thereby retaining carrier 572 in that folded arrangement. This folded arrangement also allows flap 584 to be formed for use in retaining product samples, such as sample 586. In an alternative embodiment, an adhesive band may be retained on front portion 574 in lieu of, or in addition to, adhesive band 588.

Figure 17:
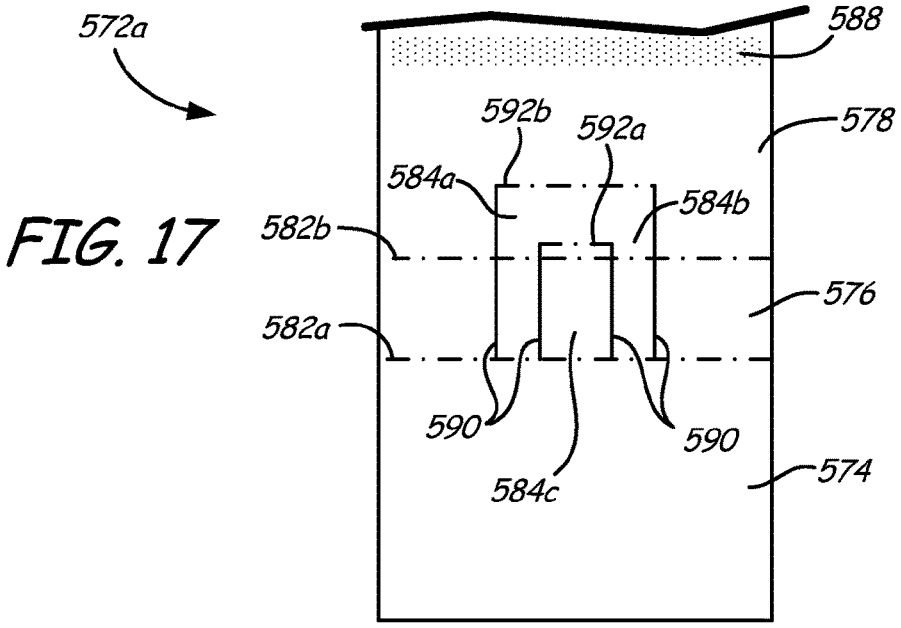
FIG. 17 is a top plan view of an alternative foldable carrier of the fifth alternative assembly, where the alternative foldable carrier is in an unfolded arrangement.

FIG. 17 illustrates an alternative sample-retention arrangement for carrier 572, referred to as carrier 572*a*, which includes outer flaps 584*a* and 584*b*, and inner flap 584*c*. Flaps 584*a*-584*c* are defined by slits 590, which are longitudinal slits that extend normal to fold lines 582*a* and 582*b*. In the illustrated embodiment, each slit 590 has a lower end at fold line 582*a*. The inner pair of slits 590 have top ends that extend past fold line 582*b*, are of the same length, and that may have a lateral crease or fold line 592*a* extending therebetween at the top ends. The outer pair of slits 590 also have top ends that extend past fold line 582*b*, are of the same length (longer in this embodiment than the inner pair of slits 590), and may that have a lateral crease or fold line 592*b* extending therebetween at the top ends.

When carrier 572*a* is folded to the arrangement shown in FIG. 14, front portion 574 may engage adhesive band 588, thereby retaining carrier 572*a* in that folded arrangement. This fold arrangement also allows flaps 586*a*-586*c* to be formed for use in retaining a product sample (not shown). In particular, outer flaps 586*a* and 586*b* may extend around one side of the product sample, while inner flap 586*c* may extend around the opposing side of the product sample.

As is evident from the exemplary embodiments illustrated in FIGS. 14-17, the product tag panel (e.g., product tag panel 524 and carrier 572) may take a number of forms for purposes of conveying information, bearing sample products, and the like. The product tag panel may be a single planar sheet (such as illustrated in assemblies 10, 210, 310, and 410) or may be a folded sheet (such as illustrated in assemblies 110 and 510). In addition, product tag panel 524 may have a separable section thereon.

Such a separable section may be removed from assembly 510 by perforations to serve as an instant coupon for product sales, as a coupon for future product purchases, a mail-in product warranty registration card, or some other purpose where it is desired to separate information from assembly 510 and/or product to which it is attached. In addition, other articles may be attached to product tag panel 524, such as for example, a product instruction booklet, product dispenser, or the like. Such items may be affixed by an adhesive or other suitable known attachment or bonding scheme.

Figure 18:
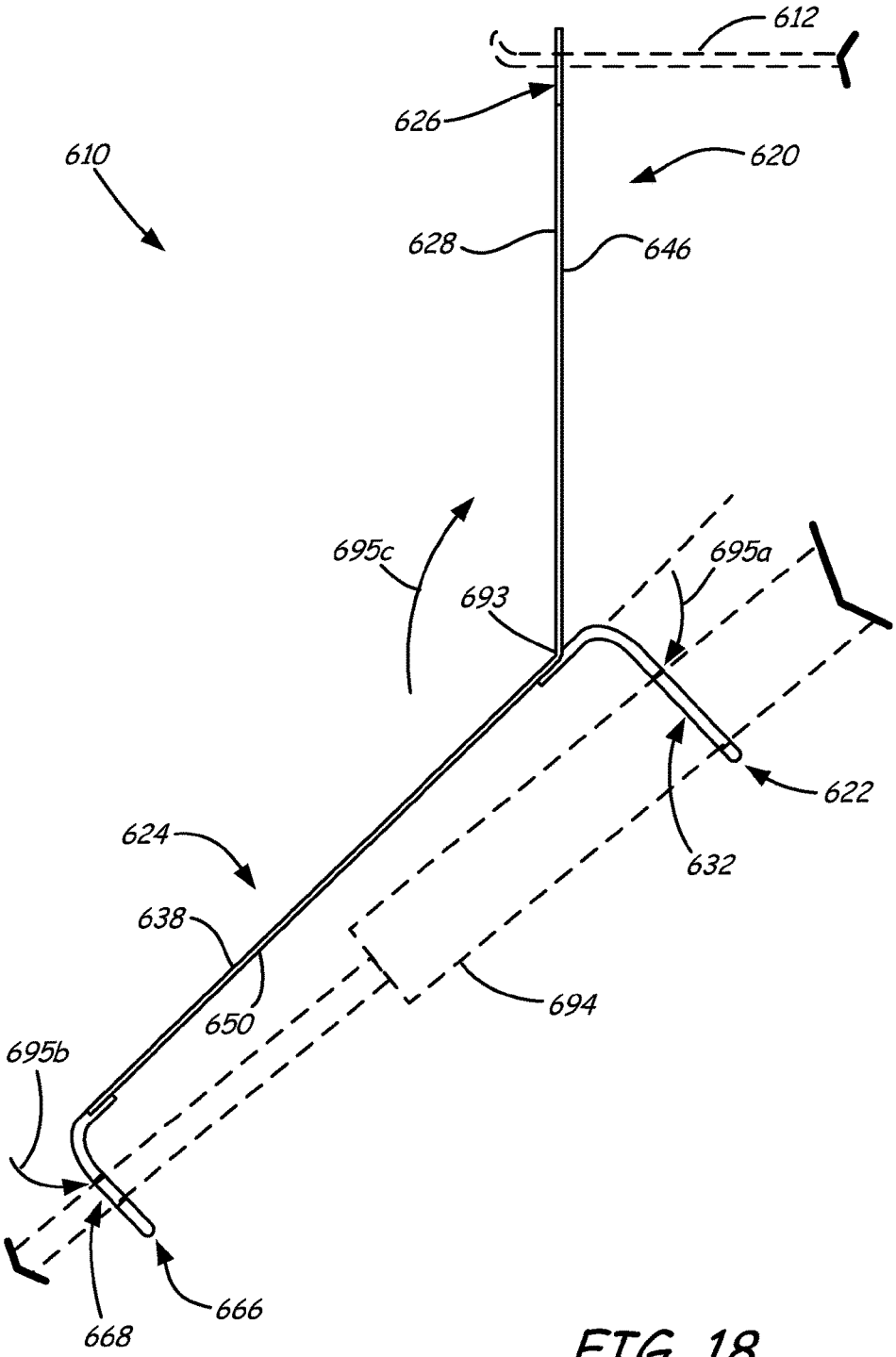
FIG. 18 is a side view of a sixth alternative embodiment of the assembly, where the sixth alternative assembly is secured to a screwdriver-type product and suspended from a hook for display, and where the sixth embodied assembly includes a hang tab panel that is integrally formed with a product tag panel of the assembly in a foldable arrangement.
Figure 19:
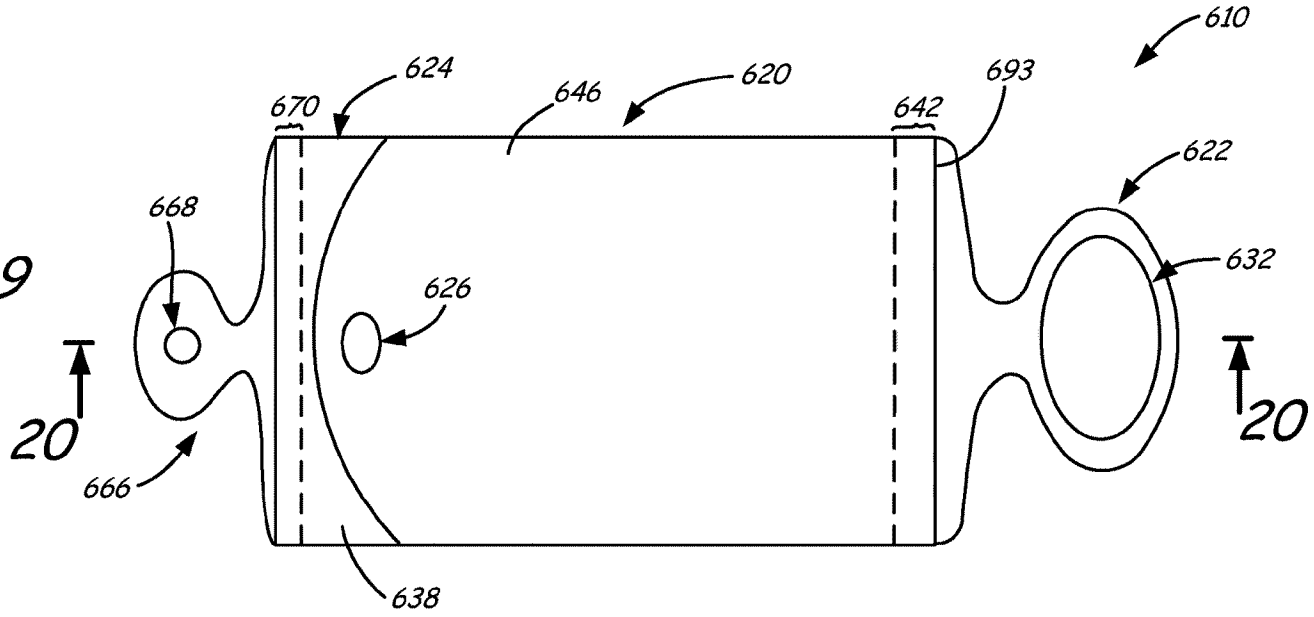
FIG. 19 is a top plan view of the sixth alternative assembly.
Figure 20:
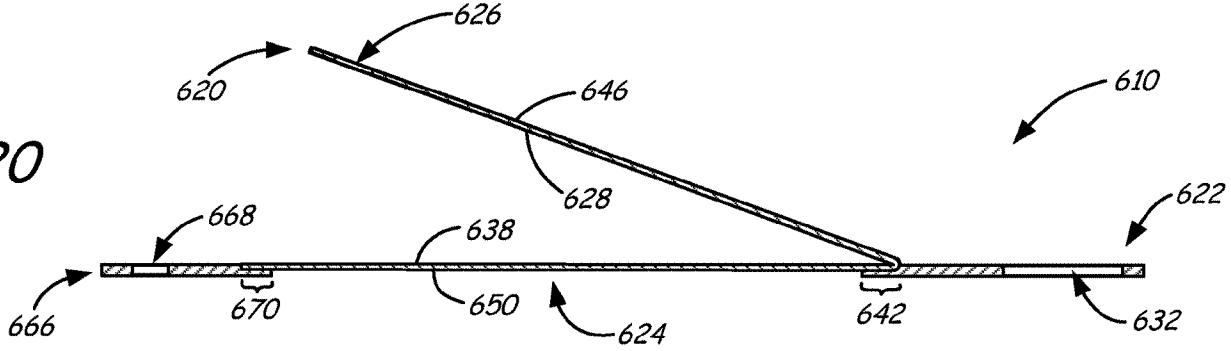
FIG. 20 is a sectional view of the sixth alternative assembly as taken along section lines 20-20 in FIG. 19.

FIGS. 18-20 illustrate assembly 610, which is a sixth alternative to assembly 10 (shown in FIGS. 1-3A), and where the respective reference labels are increased by "600" relative to FIGS. 1-3. As shown in FIG. 18, assembly 610 includes hang tab panel 620, aperture panel 622, product tag panel 624, and lower aperture panel 666. In this embodiment, hang tab panel 620 and product tag panel 624 are integrally formed from the same sheet of tab/tag material, which is folded over at hinge line 693 in a similar manner to that discussed above for assembly 110 (shown in FIG. 4).

Furthermore, aperture panel 622 extends adjacent to rear surface 646 of hang tab panel 620 and rear surface 650 of product tag panel 624. As such, aperture 632 of aperture panel 622 and aperture 668 of lower aperture panel 666 may be used to retain a product, such as screwdriver 694 (shown with hidden lines). In this embodiment, apertures 632 and 668 may also have different dimensions to accommodate the dimensions of the intended products. For example, as shown, aperture 632 has a larger diameter than aperture 668 such that aperture 632 may retain the handle portion of screwdriver 694 and aperture 668 may retain the smaller-diameter, head portion of screwdriver 694.

During use, aperture panel 622 and lower aperture panel 666 may be bent downward, as depicted by arrows 695*a* and 695*b*, and screwdriver 694 may be inserted through apertures 632 and 694 to screwdriver 694 to assembly 610. Hang tab panel 620 may then be opened (i.e., unfolded) from product tag panel 624, as depicted by arrow 695*c*, where front surface 628 of hang tab panel 620 and front surface 638 of product tag panel 638 provide suitable locations for presenting indicia or other information.

Hang tab panel 620 may then be mounted on to hook 612 with aperture 626 to suspend to assembly 610 and screwdriver 694 from hook 612. While suspended from hook 612, indicia or other information printed on one or more of front surfaces 628 and 638 may then be prominently displayed. For example, front surfaces 628 and 638 are suitable for displaying information relating to screwdriver 694, such as brand logos, product identification, price information, universal product codes, and the like. As such, assembly 610 is also a convenient and effective system for retaining and displaying products, such as screwdriver 694.

As shown in FIGS. 19 and 20, bond zone 642 between aperture panel 622 and product tag panel 624 engages a portion of product tag panel 624, as well as hinge line 693, in the same manner as discussed above for assembly 110 (shown in FIG. 4). However, in this embodiment, the bond zone corresponding to bond zone 42 (shown in FIGS. 2 and 3) is omitted, since the opposing end of aperture panel 622 is not connected to hang tab panel 620.

Assembly 610 may be manufactured using a similar process to that discussed above for assembly 10 and sheet 10*a* (shown in FIG. 3A). In this embodiment, however, a strip of tab/tag material for the foldable hang tab panels 620/product tag panels 624 may be aligned with advancing strips of elastic materials for the aperture panels 622 and the lower aperture panels 666. The advancing strips may then be bonded together (e.g., thermally bonded) at bond zone areas that correspond to bond zones 642 and 670 for each assembly 610.

Furthermore, because hang tab panel 620 and product tag panel 624 are provided as a single, foldable sheet, indicia or other information may be pre-printed on the single, foldable sheet prior to the bonding step. Alternatively, after the bonding step, indicia or other information may be printed on one or more of the surfaces of hang tab panel 620 and product tag panel 624, as desired. Score or perforation lines may then be formed in the advancing sheet to define the separable assemblies 610, and apertures 626, 632, and 668 may be cut out of the advancing sheet for each assembly 610. After the manufacturing process is complete, the individual assemblies 610 may be separated for individual use, or maintained in sheet or roll form for bulk shipping and subsequent use.

Figure 21:
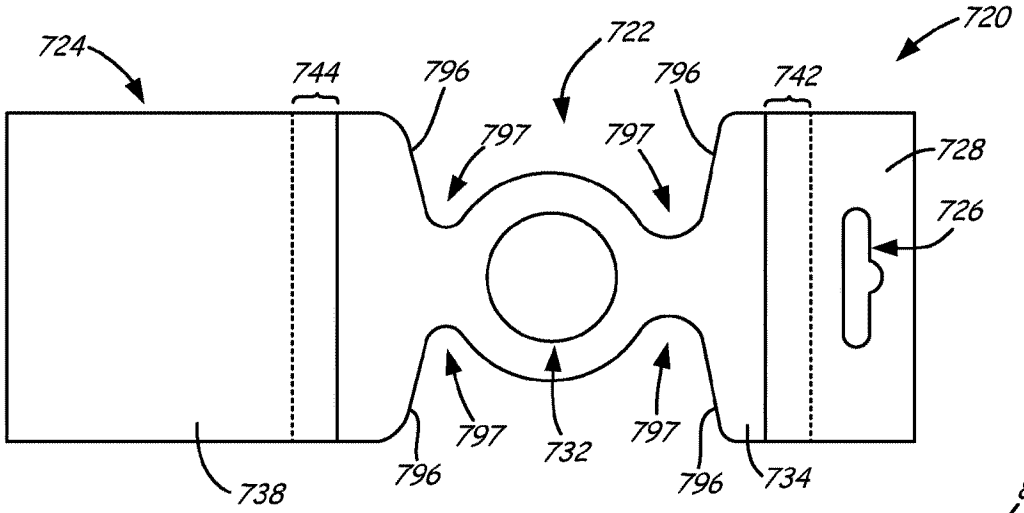
FIG. 21 is a top plan view of a seventh alternative embodiment of the assembly, where the seventh embodied assembly includes an aperture panel having shoulders defined by neck indentations.

FIG. 21 illustrates assembly 710, which is a seventh alternative to assembly 10 (shown in FIGS. 1-3A), and where the respective reference labels are increased by "700"

relative to FIGS. 1-3. As shown in FIG. 21, assembly 710 includes aperture panel 722 having shoulders 796 defined by neck indentations 797 around aperture 732. Examples of suitable arrangements for shoulders 796 and neck indentations 797 are disclosed in U.S. Pat. No. 7,281,345.

Figure 22:
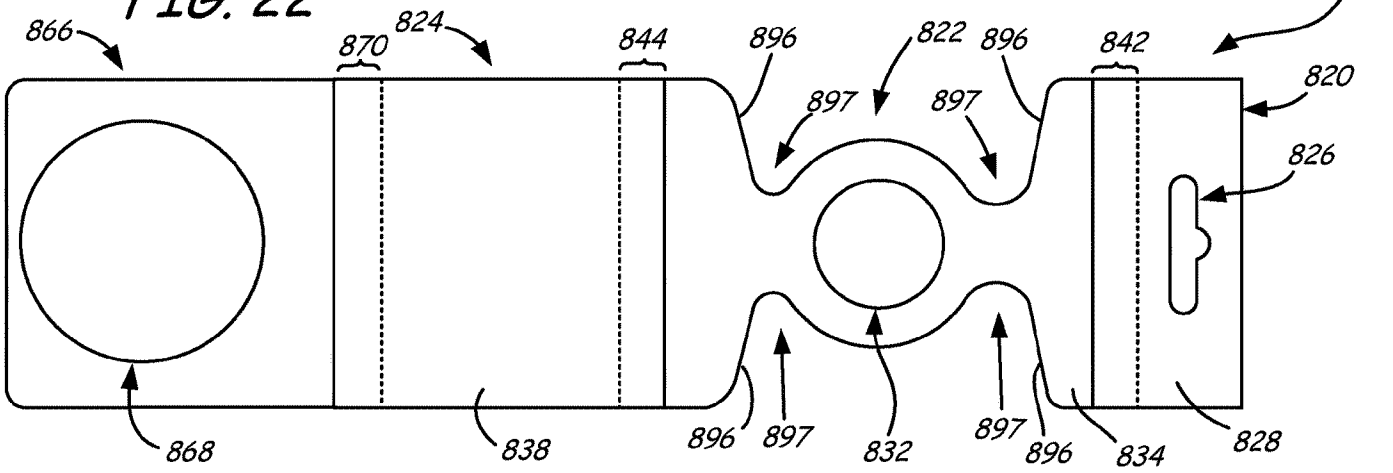
FIG. 22 is a top plan view of an eighth alternative embodiment of the assembly, where the eighth embodied assembly includes an aperture panel having shoulders defined by neck indentations, and also includes a lower aperture panel.

FIG. 22 illustrates assembly 810, which is an eighth alternative to assembly 10 (shown in FIGS. 1-3A), and where the respective reference labels are increased by "800" relative to FIGS. 1-3. As shown in FIG. 22, assembly 810 is similar to assembly 710 (shown in FIG. 21), and further includes lower aperture panel 866 having aperture 868. Elastic panel 866 and aperture 868 may function in the same manner as discussed above for elastic panel 466 and aperture 468 (shown in FIGS. 11-13) for providing an additional securing mechanism.

Figure 23:
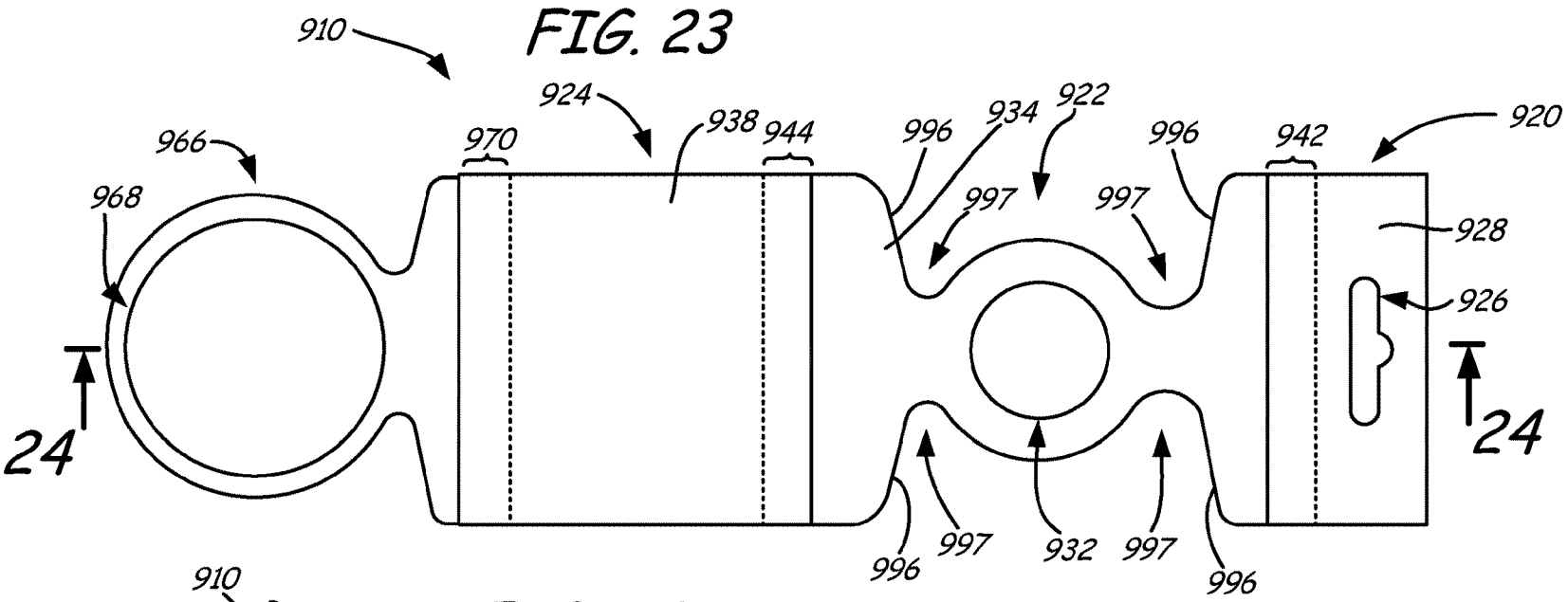
FIG. 23 is a top plan view of a ninth alternative embodiment of the assembly, where the ninth embodied assembly includes a thermosensitive aperture panel.
Figure 24:
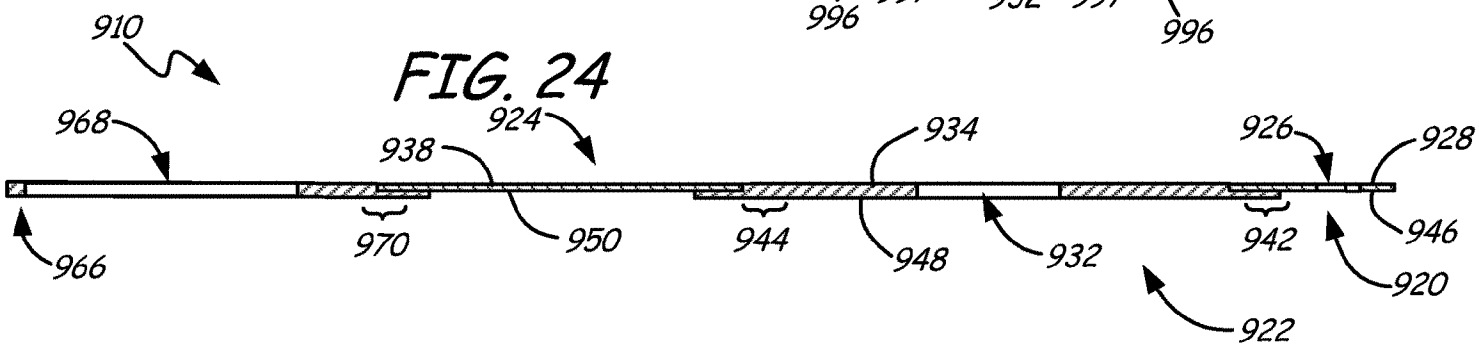
FIG. 24 is a sectional view of the ninth alternative assembly as taken along section lines 24-24 in FIG. 23.

FIGS. 23 and 24 illustrate assembly 910, which is a ninth alternative to assembly 10 (shown in FIGS. 1-3A), and where the respective reference labels are increased by "900" relative to FIGS. 1-3. In this embodiment, aperture panel 910 includes shoulders 996 defined by neck indentations 997 around aperture 932, as discussed above for assemblies 710 and 810 (shown in FIGS. 21 and 22). In comparison to assemblies 710 and 810, however, aperture panel 922 compositionally includes one or more thermosensitive materials that shrink when exposed to heat above a specified temperature. Such materials are sometimes commonly referred to as "shrink wrap" or "shrink film" materials.

Suitable thermosensitive materials for use in aperture panel 922 include polymeric materials (e.g., polyolefins) that shrink tightly over covered items when heated. The suitable thermosensitive material may be compounded to shrink in one direction (unidirectional or mono-directional) or in both directions (bi-directional). During formation of a thermosensitive material film, the thermosensitive material may be stretched while warm to orient the molecules from their initial random pattern. Cooling the film sets the film's characteristics until it is re-heated, which then causes the film to shrink back to its initial dimensions.

The thermosensitive material of aperture panel 922 is desirably flexible enough to be inserted onto a product to which assembly 910 is to be attached. However, in comparison to the elastic materials of the above-discussed aperture panels, which desirably have dimensions that are smaller than the dimensions of the intended products, due to the shrinkable nature of the thermosensitive material, aperture 932 may have dimensions that are larger than the dimensions of the intended product. This allows the product to be readily inserted through aperture 932. Once the product has been inserted into aperture 932, heat may be applied to aperture panel 922 (at least to a central portion thereof that includes aperture 932, including and/or between neck indentations 997) to a temperature necessary to cause shrinkage of the central portion. This secures assembly 910 to the product.

The shape of aperture panel 922 may be dependent upon the thermosensitive material used, as well as the product to which it is to be applied. For instance, a narrower loop, longer or wider necks, broader shoulders, or some other configuration (e.g., even rectangular, such as panel 22, shown in FIGS. 1 and 2) may be suitable, depending upon the desired end characteristics of assembly 910 relative to the product to which assembly 910 is to be attached.

The provision of the neck indentations 797 may also facilitate sufficient separation of the heated central portion of aperture panel 922 from bond zones 942 and 944. Such physical separation may be desirable, as the integrity of bond zones 942 and 944 are desirably not be compromised by the heating of the aperture panel 922 as it is "shrink bound" and secured to a product.

In one embodiment, lower aperture panel 966 may compositionally include either one or more elastic materials to function in the same manner as discussed above for lower aperture panel 446 (shown in FIGS. 11-13). In alternative embodiment, lower aperture panel 966 may compositionally include one or more thermosensitive materials to function in a similar manner to that discussed above for aperture panel 922.

Although aperture panel 922 may be subject to some deformation as heat is applied thereto, it may still be used to bear indicia on front surface 934. During use, a product may be inserted through apertures 932 and 968. One or both of aperture panel 922 and lower aperture panel 966 may then be subjected to heat to shrink bound aperture panel 992 and/or lower aperture panel 966 around the product. Hang tab panel 928 may then be mounted on to a retention mechanism with aperture 926 to suspend to assembly 910 and the product from the retention mechanism. While suspended from the retention mechanism, indicia or other information printed on one or more of front surfaces 928, 934, and 938 may then be prominently displayed. For example, front surface 928 of hang tab panel 920 and front surface 938 of product tag panel 924 are suitable for displaying information relating to the product, such as brand logos, product identification, price information, universal product codes, and the like. As such, assembly 910 is also a convenient and effective system for retaining and displaying products.

Figures 25, 26:
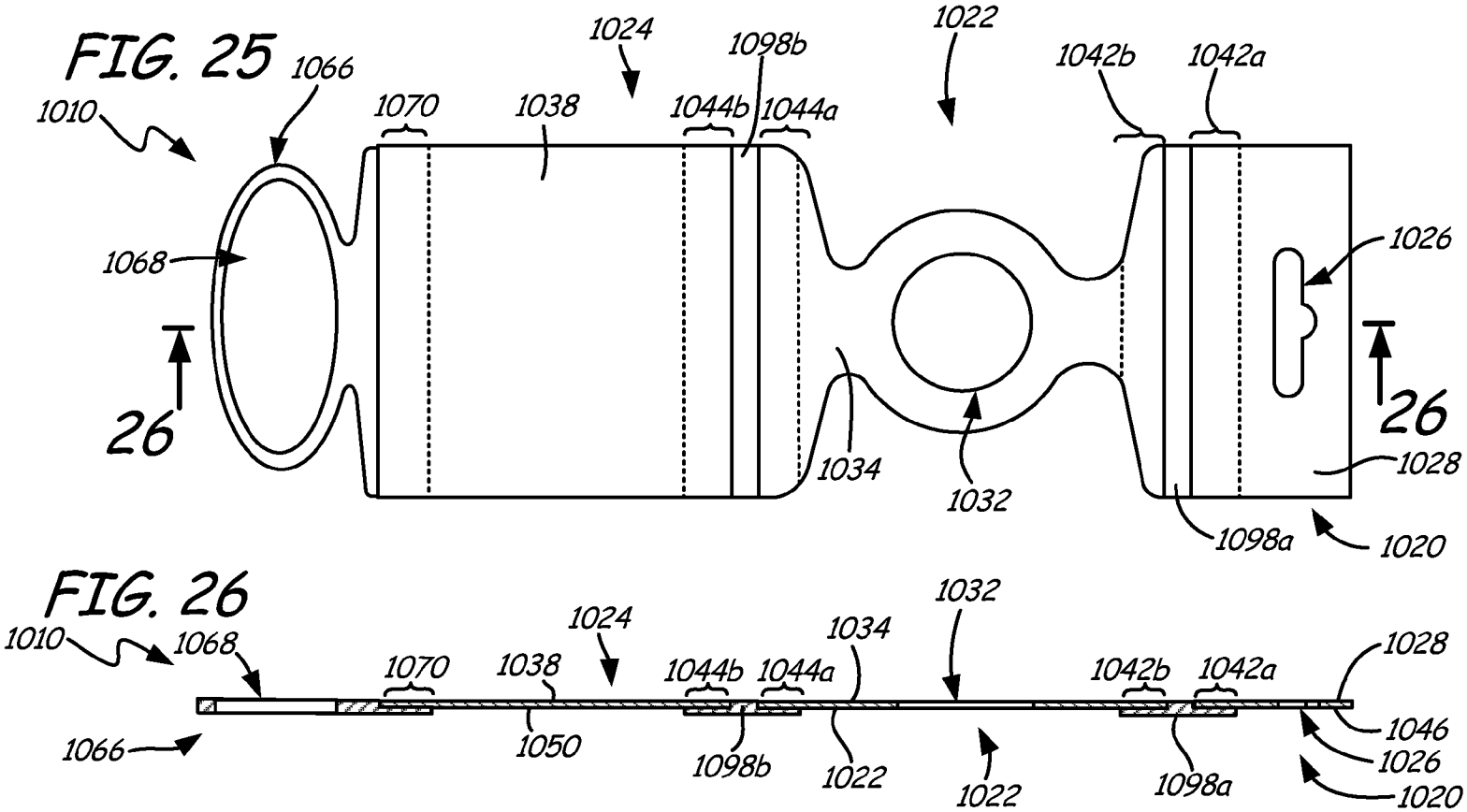
FIG. 25 is a top plan view of a tenth alternative embodiment of the assembly, where the tenth embodied assembly includes a thermosensitive aperture panel, and also includes additional elastic bridge panels.
FIG. 26 is a sectional view of the tenth alternative assembly as taken along section lines 26-26 in FIG. 25.

FIGS. 25 and 26 illustrate assembly 1010, which is a tenth alternative to assembly 10 (shown in FIGS. 1-3A), and where the respective reference labels are increased by "1000" relative to FIGS. 1-3. Assembly 1010 is similar to assembly 910 (shown in FIGS. 23 and 24), and includes aperture panel 1022 and lower aperture panel 1066, one or both of which compositionally includes a thermosensitive material.

Assembly 1010 also includes elastic bridge panels 1098*a* and 1098*b*, located on the opposing ends of aperture panel 1022. Suitable materials for elastic bridge panels 1098*a* and 1098*b* include those discussed above for aperture panel 22 (shown in FIGS. 1-3A). As shown, elastic bridge panel 1098*a* interconnects hang tab panel 1020 and aperture panel 1022 with bond zones 1042*a* and 1042*b*, respectively. Similarly, elastic bridge panel 1098*b* interconnects aperture panel 1022 and product tag panel 1024 with bond zones 1044*a* and 1044*b*, respectively. In an alternative embodiment, which is suitable when lower aperture panel 1066 compositionally includes a thermosensitive material, an additional elastic bridge feature (not shown) may interconnect product tag panel 1024 and lower aperture panel 1066.

The addition of elastic bridge panels 1098*a* and 1098*b* is suitable for further insulating hang tab panel 1020 and product tag panel 1024 from the deformation that occurs upon heating of aperture panel 1022. Elastic bridge panels 1098*a* and 1098*b* may also further provide flexible and resilient bridges or connections between aperture panel 1022 and hang tab panel 1020 and product tag panel 1024.

Figure 27:
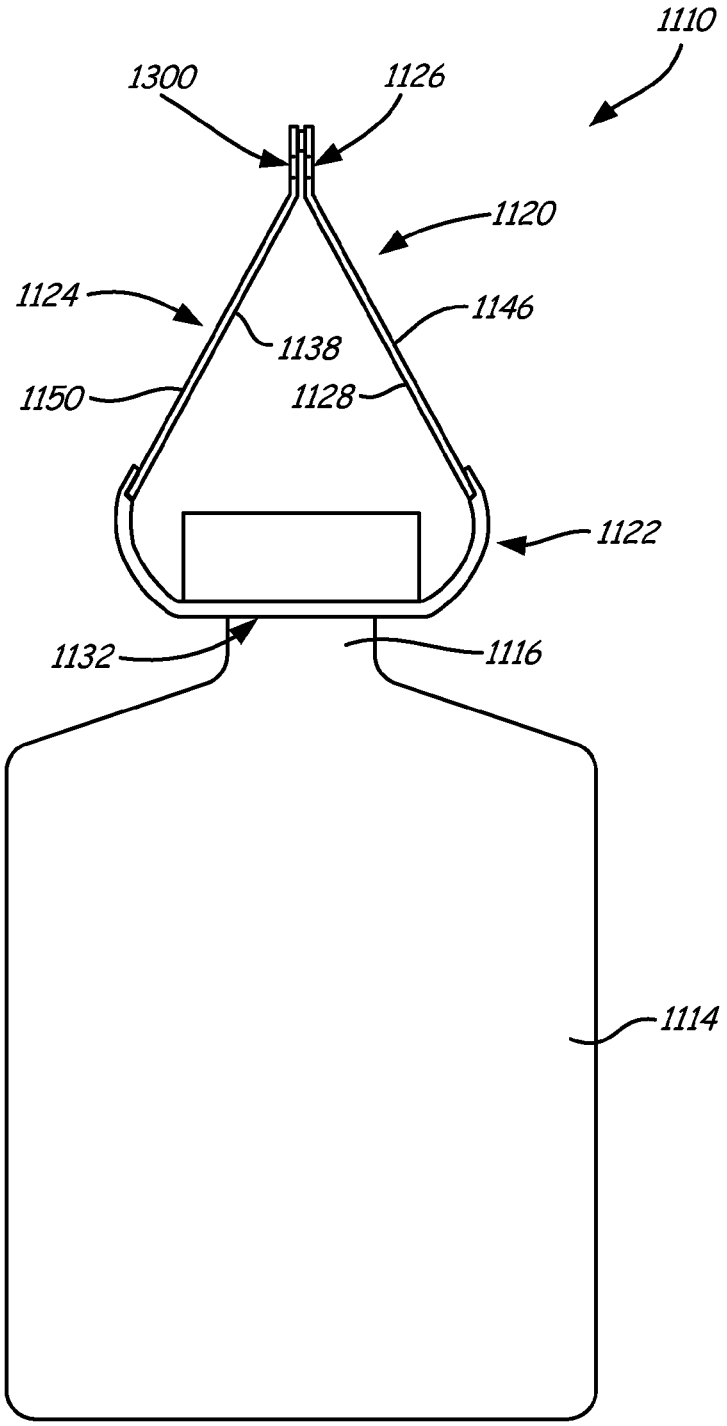
FIG. 27 is a side view of an eleventh alternative embodiment of the assembly, where the eleventh alternative assembly is secured to a bottle and suspended from a hook for display, and where the eleventh embodied assembly includes a foldable arrangement in which a hang tab panel and a product tag panel are secured to together.
Figure 28:
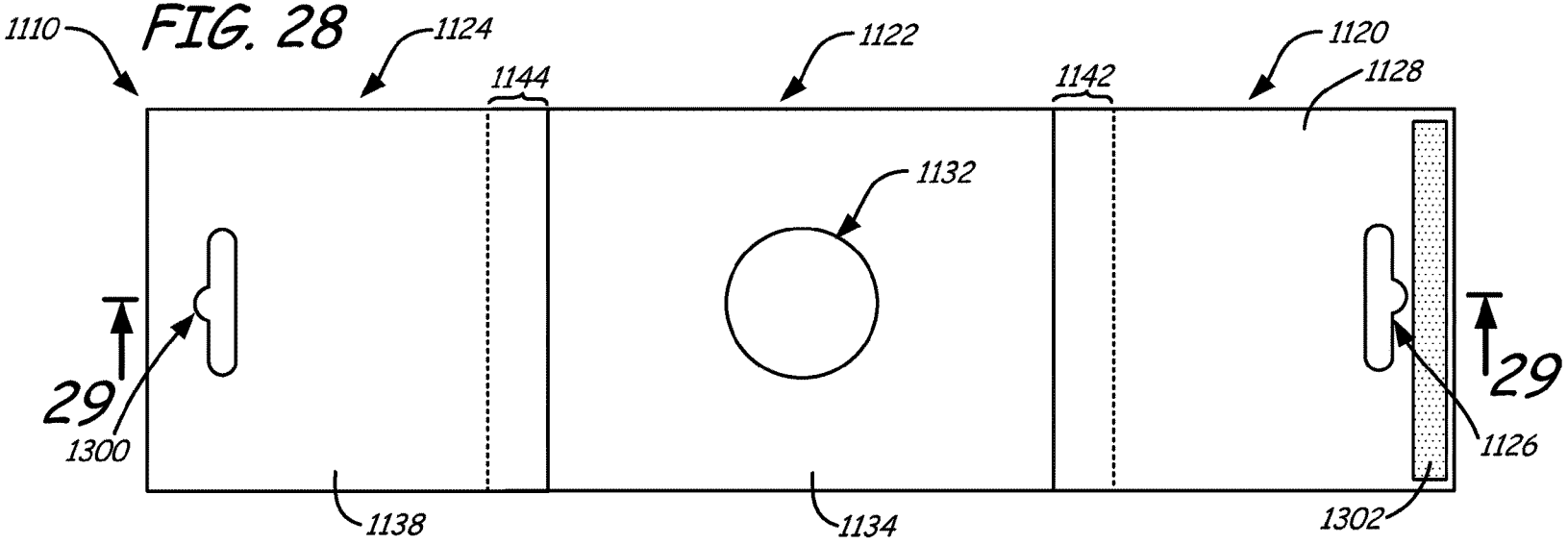
FIG. 28 is a top plan view of the eleventh alternative assembly.
Figure 29:
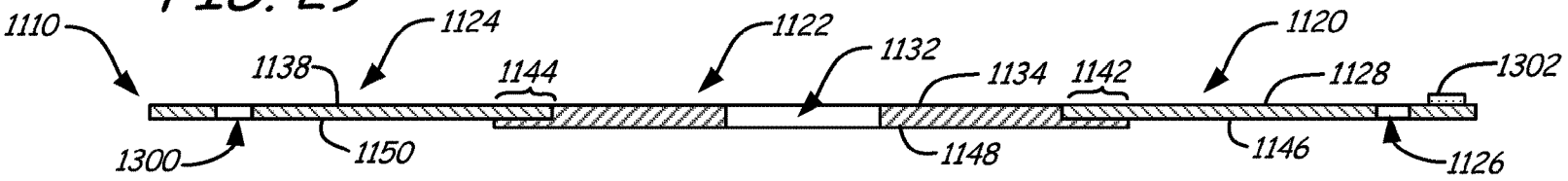
FIG. 29 is a sectional view of the eleventh alternative assembly as taken along section lines 29-29 in FIG. 28.

FIGS. 27-32 illustrate additional alternative embodiments in which the assemblies are folded end-to-end during use to suspend and display products from retention mechanisms. FIGS. 27-29 illustrate assembly 1110, which is an eleventh alternative to assembly 10 (shown in FIGS. 1-3A), and where the respective reference labels are increased by "1100" relative to FIGS. 1-3. As shown in FIG. 27, in this embodiment, both hang tab panel 1120 and product tab panel 1124 include apertures for engagement with hook 1112 or other retention mechanism. In particular, product tab panel 1124 also includes aperture 1300.

During use, portions of a product (e.g., neck 1116 and cap 1118 of bottle 1114) may be inserted through aperture 1132 of aperture panel 1122 to secure bottle 1114 to assembly 1110. Assembly 1110 may then be folded up such that the opposing ends of hang tab panel 1120 and product tab panel 1124 contact each other. In one embodiment, aperture panel 1122 bends (as illustrated in FIG. 27) to accommodate such folding. In this situation, apertures 1126 and 1300 are desirably aligned to allow assembly 1110 to be mounted on to hook 1112, thereby suspending assembly 1110 and bottle 1114 from hook 1112.

While suspended from hook 1112, indicia or other information printed on one or more of the front and rear surfaces of assembly 1110 may then be prominently displayed. For example, rear surface 1146 of hang tab panel 1120 and rear surface 1150 of product tag panel 1124 are suitable for displaying information relating to bottle 1114, such as brand logos, product identification, price information, universal product codes, and the like.

As shown in FIGS. 28 and 29, hang tab panel 1120 includes adhesive band 1302, which is a band of one or more adhesive materials (e.g., one or more pressure sensitive adhesives). When assembly 1110 is folded to the arrangement shown in FIG. 27, a portion of product tag panel 1124 may engage adhesive band 1302, thereby retaining assembly 1110 in the folded arrangement shown in FIG. 27. In an alternative embodiment, an adhesive band may be retained on product tag panel 1124 in lieu of, or in addition to, adhesive band 1302.

Figure 30:
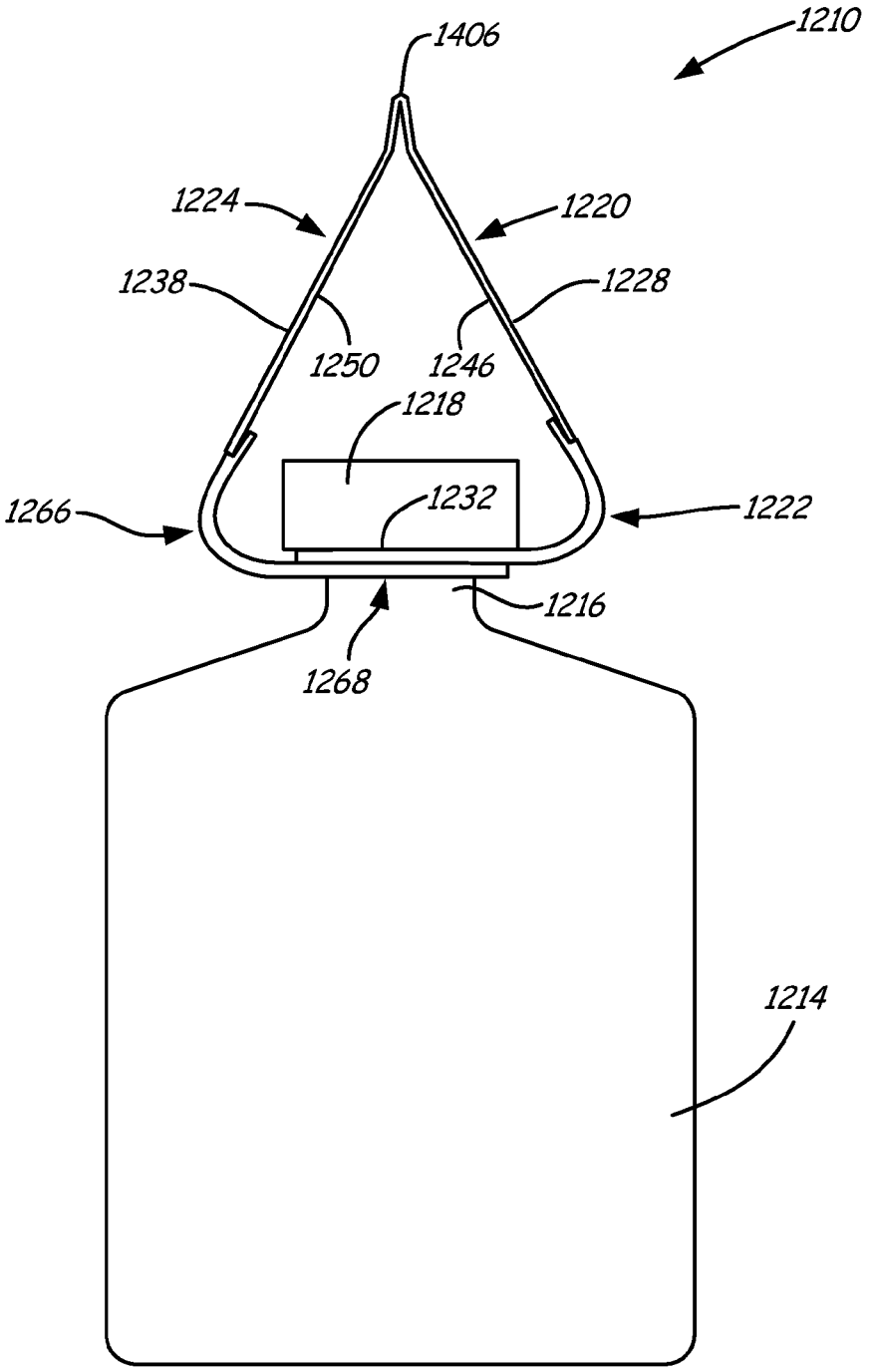
FIG. 30 is a side view of a twelfth alternative embodiment of the assembly, where the twelfth alternative assembly is secured to a bottle and suspended from a hook for display, and where the twelfth embodied assembly includes a foldable arrangement in which elastic panels are secured to together.
Figure 31:
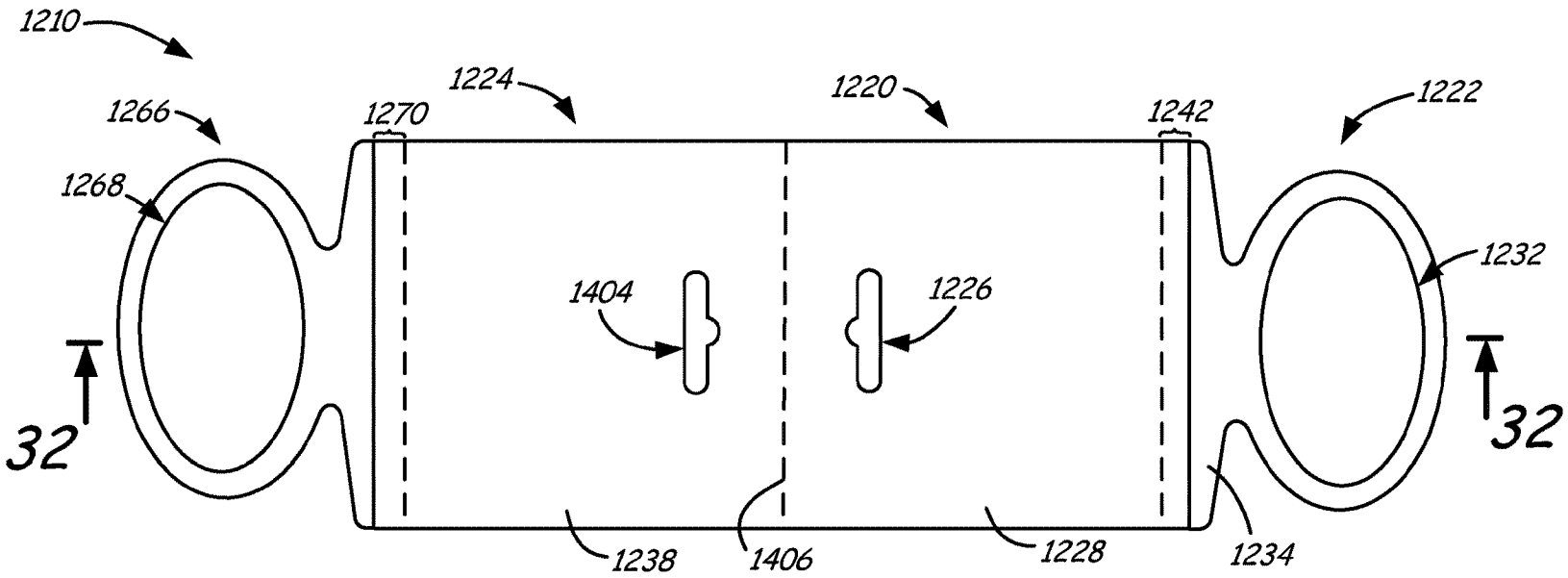
FIG. 31 is a top plan view of the twelfth alternative assembly.
Figure 32:
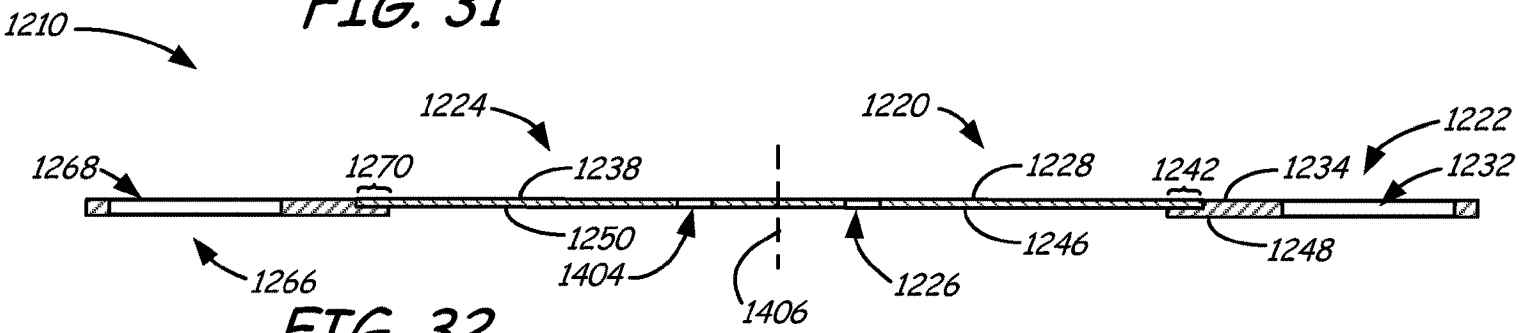
FIG. 32 is a sectional view of the twelfth alternative assembly as taken along section lines 32-32 in FIG. 31.

FIGS. 30-32 illustrate assembly 1210, which is a twelfth alternative to assembly 10 (shown in FIGS. 1-3A), and where the respective reference labels are increased by "1200" relative to FIGS. 1-3. As shown in FIG. 30, in this embodiment, both hang tab panel 1220 and product tab panel 1224 include apertures for engagement with hook 1212 or other retention mechanism. In particular, product tab panel 1224 also includes aperture 1404.

Furthermore, hang tab panel 1220 and product tag panel 1224 may be formed same sheet of panel material, which is folded over at hinge line 1406. Additionally, aperture panel 1222 is bonded to the opposing end of hang tab panel 1220 from hinge line 1406. Assembly 1210 also includes lower aperture panel 1266, which may function in a similar manner to lower aperture panel 466 (shown in FIGS. 11-13).

During use, assembly 1210 may be folded along hinge line 1406 such that apertures 1226 and 1404 are generally aligned. Portions of a product (e.g., neck 1216 and cap 1218 of bottle 1214) may then be inserted through aperture 1268 of lower aperture panel 1266 and aperture 1232 of aperture panel 1222 to secure bottle 1214 to assembly 1210. The dual-aperture retention further secures bottle 1214 to assembly 1210, while also maintaining assembly 1210 in the folded arrangement shown in FIG. 30.

The general alignment of apertures 1226 and 1404 allow assembly 1210 to be mounted on to hook 1212, thereby suspending assembly 1210 and bottle 1214 from hook 1212. While suspended from hook 1212, indicia or other information printed on one or more of the front and rear surfaces of assembly 1210 may then be prominently displayed. For example, rear surface 1246 of hang tab panel 1220 and rear surface 1250 of product tag panel 1224 are suitable for displaying information relating to bottle 1214, such as brand logos, product identification, price information, universal product codes, and the like.

As shown in FIGS. 31 and 32, hang tab panel 1220 is bonded to aperture panel 1222 along bond zone 1242, and product tag panel 1224 is bonded to lower aperture panel 1266 along bond zone 1270. Accordingly, in this embodiment, the relative locations of hang tab panel 1220 and aperture panel 1222 preclude the need for a bond zone corresponding to bond zone 44 (shown in FIGS. 2 and 3). In alternative embodiments, one or both of hang tab panel 1220 and product tag panel 1224 may include a band of one or more adhesive materials (e.g., one or more pressure sensitive adhesives) or other mechanical forms of engagement to assist in maintaining assembly 1210 in the folded arrangement shown in FIG. 30.

The hang tab and product tag assemblies disclosed herein are elegant and simple arrangements to provide additional product promotion and/or informational material, at the point of sale. Each assembly further provides the product with a hang tab suitable for allowing the product to be hung from a hook for display and easy retrieval by a consumer or user.

Although the hang tab and product tag assembly disclosed herein has been described with respect to several embodiments, workers skilled in the art will recognize that changes may be made in form and detail without departing from the spirit and scope of the disclosure.

The invention claimed is:

1. A hang tab and product tag assembly comprising:
- a first panel comprising a first retention aperture configured to engage with a retention mechanism, wherein the first panel is inextensible;
- a second panel comprising:
  - an elastic material;
  - a first end overlapping and flatly conjoined with the first panel at a first bond zone;
  - a second end; and
  - an aperture located between the first end and the second end, wherein the aperture is configured to stretch between relaxed and stretched states; and
- a third panel overlapping and flatly conjoined with the second end of the second panel at a second bond zone, wherein the third panel is inextensible, and wherein the third panel further comprises a second retention aperture.

2. The hang tab and product tag assembly of claim 1, wherein the first panel and the third panel are each less flexible than the second panel.

3. The hang tab and product tag assembly of claim 1, wherein the third panel comprises a first portion and a second portion that are connected to each other along a hinge line.

4. The hang tab and product tag assembly of claim 1, and further comprising a foldable carrier that is integrally connected to the third panel.

5. The hang tab and product tag assembly of claim 1, wherein the third panel comprises a hinge line, and wherein the third panel is operably connected to the second panel adjacent to the hinge line.

6. The hang tab and product tag assembly of claim 1, further comprising an adhesive disposed on the third panel.

7. A hang tab and product tag assembly comprising:
- a first panel comprising an aperture configured to engage with a retention mechanism, wherein the first panel is inextensible;
- a second panel comprising:
  - an elastic material;
  - a first end overlapping and flatly conjoined with the first panel at a first bond zone;

a second end; and an aperture located between the first end and the second end, wherein the aperture is configured to stretch between relaxed and stretched states;

a third panel overlapping and flatly conjoined with the second end of the second panel at a second bond zone, wherein the third panel is inextensible; and a fourth panel operably secured to the third panel, the fourth panel comprising an aperture that is configured to adjust to different dimensions.

8. The hang tab and product tag assembly of claim 7, wherein the third panel comprises a first portion and a second portion that are connected to each other along a hinge line.

9. The hang tab and product tag assembly of claim 7, and further comprising a foldable carrier that is connected to the third panel.

10. The hang tab and product tag assembly of claim 7, further comprising an adhesive disposed on the third panel.

11. A hang tab and product tag assembly comprising:

a first inextensible panel comprising an aperture configured to engage with a retention mechanism;

a second panel configured to extend at an angle from the first panel, wherein at least a middle portion of the second panel compositionally comprises an elastic material, the second panel comprising:

a first end flatly conjoined with the first panel;

a second end;

the middle portion located between the first end and the second end, wherein the middle portion includes an aperture through the second panel that is configured to stretch between relaxed and stretched states; and a second portion of the second panel defines a border of the second panel, and wherein the middle portion extends across an opening of the border; and a third inextensible panel flatly conjoined with the second end of the second panel, wherein the third panel is configured to extend at an angle from the second panel, the third panel having a surface comprising information selected from the group consisting of textual indicia, illustrative indicia, tactile information, machine readable information, and combinations thereof;

wherein the first panel, the second portion of the second panel, and the third panel are integrally connected.

12. A hang tab and product tag assembly of claim 11, wherein the first panel and the third panel are each less flexible than the middle portion of the second panel.

13. The hang tab and product tag assembly of claim 11, and further comprising a fourth elastic panel operably secured to the third panel, the fourth elastic panel comprising an aperture that is configured to adjust to different dimensions.

14. The hang tab and product tag assembly of claim 11, further comprising a second retention aperture disposed in the third panel.

15. The hang tab and product tag assembly of claim 11, further comprising an adhesive disposed on the third panel.

* * * * *